US007185569B2

(12) United States Patent
Knight et al.

(10) Patent No.: US 7,185,569 B2
(45) Date of Patent: Mar. 6, 2007

(54) MULTIPURPOSE FOLDING TOOL WITH TOOL BIT HOLDER AND BLADE LOCK

(75) Inventors: Nathan Knight, Portland, OR (US); Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 11/013,896

(22) Filed: Dec. 15, 2004

(65) Prior Publication Data

US 2005/0150334 A1 Jul. 14, 2005

Related U.S. Application Data

(63) Continuation-in-part of application No. 10/756,032, filed on Jan. 13, 2004.

(51) Int. Cl.

| | |
|---|---|
| ***B25B 23/00*** | (2006.01) |
| ***B25B 23/10*** | (2006.01) |
| ***B25B 15/00*** | (2006.01) |
| ***B25G 3/02*** | (2006.01) |

(52) U.S. Cl. ..... 81/450; 81/438; 81/448; 81/28; 7/165

(58) Field of Classification Search ..... 81/450, 81/438, 439, 444, 448, 427.5, 28, 180.1; 7/118, 165, 135, 168; 279/23.1
See application file for complete search history.

(56) References Cited

U.S. PATENT DOCUMENTS

| | | | | |
|---|---|---|---|---|
| 595,909 A | | 12/1897 | Evertz | |
| 653,807 A | * | 7/1900 | Hofstetter | 24/12 |
| 896,746 A | | 8/1908 | McCarty | |
| 969,909 A | | 9/1910 | Schrade | |
| 1,361,021 A | | 12/1920 | Copeman | |
| 1,362,143 A | | 12/1920 | Rohrer | |
| 2,158,728 A | * | 5/1939 | Peters | 279/102 |
| 2,407,897 A | | 9/1946 | Newman | |
| 2,439,071 A | | 4/1948 | Basham | |

(Continued)

FOREIGN PATENT DOCUMENTS

| | | |
|---|---|---|
| EP | 693018 | 1/1996 |

(Continued)

OTHER PUBLICATIONS

W.R. Case & Sons Cutlery Co., xxChanger, Exchangeable Blade Knife, Photocopy of Owner's Manual, Copyright 1987.

(Continued)

*Primary Examiner*—Joseph J. Hail, III
*Assistant Examiner*—Bryan Muller
(74) *Attorney, Agent, or Firm*—Chernoff, Vilhauer, McClung & Stenzel, LLP

(57) ABSTRACT

A folding multipurpose hand tool including a pivoted latch that engages side walls of a handle and a base of a folding tool member to hold the folding tool member in a selection position. A separate safety interlock latch keeps a folding blade stowed in a handle when another tool is moved from a first position with respect to the handle. A tool bit holder securely holds and drives reduced thickness tool bits that can also be engaged in and driven by conventional sockets having a regular hexagonal shape.

9 Claims, 21 Drawing Sheets

U.S. PATENT DOCUMENTS 4,073,057 A 2/1978 Gilbert
4,169,312 A 10/1979 Mar
4,233,737 A 11/1980 Poehlmann
4,238,862 A 12/1980 Leatherman
4,302,877 A 12/1981 Hart et al.
4,347,665 A 9/1982 Glesser
4,391,043 A 7/1983 Sizemore et al.
4,648,148 A 3/1987 Miceli
4,669,140 A 6/1987 Miceli
4,888,869 A 12/1989 Leatherman
4,947,552 A 8/1990 Barnes
4,995,128 A 2/1991 Montgomery et al.
5,014,379 A 5/1991 Hull et al.
5,033,140 A 7/1991 Chen et al.
5,044,079 A 9/1991 Gibbs
5,095,624 A 3/1992 Ennis
5,245,721 A 9/1993 Lowe et al.
5,251,353 A 10/1993 Lin
5,280,659 A * 1/1994 Park ..... 7/128
5,309,798 A * 5/1994 Markwart et al. ..... 81/438
5,327,651 A 7/1994 Favreau
5,351,586 A 10/1994 Habermehl et al.
5,481,949 A * 1/1996 Yen ..... 81/438
5,495,673 A 3/1996 Gardineo et al.
5,502,895 A 4/1996 Lemaire
5,511,310 A 4/1996 Sessions et al.
5,586,847 A 12/1996 Mattern, Jr. et al.
5,647,129 A 7/1997 Stamper
5,685,079 A 11/1997 Brothers et al.
5,692,304 A 12/1997 Campbell
5,711,194 A 1/1998 Anderson et al.
5,765,247 A 6/1998 Seber et al.
5,781,950 A 7/1998 Swinden
5,791,002 A 8/1998 Gardiner et al.
5,799,400 A 9/1998 Glesser
5,809,600 A 9/1998 Cachot
5,822,867 A 10/1998 Sakai
D407,286 S 3/1999 Seber et al.
5,918,512 A 7/1999 Habermehl et al.
5,933,893 A * 8/1999 Padden ..... 7/158
5,946,752 A 9/1999 Parrish
5,979,059 A 11/1999 Leatherman
6,000,080 A 12/1999 Anderson et al.
6,003,180 A 12/1999 Frazer
6,009,582 A 1/2000 Harrison et al.
6,014,787 A 1/2000 Rivera
6,082,232 A 7/2000 Anderson et al.
6,088,861 A 7/2000 Sessions et al.
6,109,148 A 8/2000 Anderson et al.
6,119,560 A 9/2000 Anderson et al.
6,119,561 A 9/2000 Anderson et al.
6,122,829 A 9/2000 McHenry et al.
6,145,144 A 11/2000 Poehlmann et al.
6,145,851 A * 11/2000 Heber ..... 279/143
6,170,104 B1 1/2001 Serber et al.
6,233,769 B1 5/2001 Seber et al.
6,243,901 B1 6/2001 Elsener et al.
6,256,887 B1 7/2001 Osborne
6,257,106 B1 7/2001 Anderson et al.
6,260,453 B1 7/2001 Anderson et al.
6,276,435 B1 8/2001 Zayat, Jr.
6,282,996 B1 * 9/2001 Berg et al. ..... 81/427.5
6,282,997 B1 9/2001 Frazer
6,286,397 B1 9/2001 Taggart et al.
6,289,541 B1 * 9/2001 Anderson et al. ..... 7/128
6,298,756 B1 * 10/2001 Anderson et al. ..... 81/440
6,305,041 B1 10/2001 Montague et al.
6,318,218 B1 11/2001 Anderson et al.
6,357,068 B1 3/2002 Seber et al.
6,370,778 B1 4/2002 Conable
6,389,625 B1 5/2002 Rivera
6,397,709 B1 6/2002 Wall
6,405,395 B1 6/2002 Poehlmann et al.
D460,332 S 7/2002 Seber
6,438,848 B1 8/2002 McHenry et al.
6,481,034 B2 11/2002 Elsener et al.
6,510,767 B1 1/2003 Rivera
6,578,221 B2 6/2003 Ping
6,578,222 B2 6/2003 Anderson
6,625,832 B2 9/2003 Montague et al.
6,675,484 B2 1/2004 McHenry et al.
6,691,357 B2 2/2004 Rivera
6,763,543 B2 7/2004 Rivera
6,779,212 B2 8/2004 Anderson et al.
2001/0016987 A1 8/2001 Chen
2001/0018778 A1 9/2001 Montague et al.
2001/0037705 A1 11/2001 Frazer
2002/0029426 A1 3/2002 Seber et al.
2002/0124322 A1 9/2002 Montague
2002/0138913 A1 10/2002 Ping
2003/0037644 A1 2/2003 Rivera
2004/0237207 A1 12/2004 Rivera

FOREIGN PATENT DOCUMENTS

FR 2760955 9/1998
WO WO 99/37446 7/1999
WO WO9937446 7/1999

OTHER PUBLICATIONS

Wenger of Switzerland, WengerGrip Series, Photocopy of instruction sheet, at least as early as Nov. 1996.
Fiskars, Inc., Multi-Snip Tool Kit, Photocopy of instruction sheet and photos, at least as early as Aug. 1996.
Kershaw Knives, Multi-Tool Model A100, Photocopy from catalog and instruction sheet, at least as early as Jan. 1998.
Gerber Folding Multipurpose Tool with Holder for Replaceable Saw Blade, Photocopy of photos, at least as early as August 1998.
Gerber Multi-Lock Multi-Plier Tool Kit, Photocopy of packaging, instruction sheet and photos, at least as early as Jan. 2004.
Gerber Legendary Blades Tool with Replaceable Saw Blade Coupler, Photocopy of instruction sheet and photos, at least as early as Aug. 2004.
Kershaw Blade Traders Camp Tool, Photocopy of instruction sheet and photos, at least as early as Aug. 2004.
Gerber Freeman Exchange-a-Blade, Photocopy of instruction sheet and photos, at least as early as Aug. 2004.

* cited by examiner

MULTIPURPOSE FOLDING TOOL WITH TOOL BIT HOLDER AND BLADE LOCK

CROSS-REFERENCE TO RELATED APPLICATIONS

This application is a continuation-in-part of prior U.S. patent application Ser. No. 10/756,032 filed Jan. 13, 2004.

BACKGROUND OF THE INVENTION

The present invention relates to multipurpose folding hand tools, and particularly to such a tool in which blades may be securely locked in an extended position and in which a folding tool bit holder accepts and holds interchangeable bits of different sizes and types.

Rivera U.S. Pat. No. 6,014,787 discloses a folding multipurpose hand tool including a pair of handles, each attached to a base of one of a pair of pivotally interconnected cooperative members such as pliers jaws which can be stowed in a central channel defined by each of the handles. Folding blades can also be stowed within the central channel at the opposite end of each handle, where a selected blade can be pivoted from its stowed position within the channel to its extended position only when the respective handle is spread apart from the other handle. Other, outer blades can be stowed in outer channels facing the opposite direction from the central channel by being pivoted about a pivot axis at the end of the handle where the pivotally interconnected cooperative members such as pliers jaws are connected to each handle. Such outer blades can be moved from a stowed position in an outer channel to an extended position while the multipurpose hand tool remains in a compact folded configuration. However, they can also be opened unintentionally merely by overcoming a simple detent when the pliers are open, possibly presenting a sharp edge where it is not desired.

Also, the outer margins of the wing portions defining the outer channels are somewhat uncomfortable to grip, as when using an extended folding blade with the tool in such a compact configuration.

Berg et al. (U.S. Pat. No. 6,282,996) discloses a multipurpose folding hand tool in which blades that can be pivoted between a stowed position and an extended position with respect to a handle are held in an extended position by a latch mechanism that is pivoted on the handle. Forces exerted by a blade in such a tool are sustained by the pivot on which the latch lever is mounted in the tool handle, requiring the release lever and pivots to have ample strength to withstand forces resulting from use of the blades.

Many previously available hand tools provide for use of a single handle to drive tool bits of several different sizes and configurations. Previously available tool bit holders and the bits that can be used with such holders however, have required more space than it is desired to utilize in a compact folding tool.

It is therefore desired to provide a folding multipurpose tool that includes previously available features and is safer and more comfortable to use, less subject to failure, and more versatile than previously available tools of comparable size.

BRIEF SUMMARY OF THE INVENTION

The present invention provides answers to the aforementioned shortcomings of the prior art by providing a multipurpose folding hand tool including various improvements with respect to the previously available multipurpose folding hand tools as described herein and set forth in the following claims.

In an embodiment of one aspect of the present invention, a tool bit holder securely holds and drives a selected tool bit having a pair of opposite driver ends, keeping a non-selected driver end visible.

As a related aspect, the invention provides compact tool bits that function similarly to corresponding conventional tool bits, but that can be stored in a smaller space.

In an embodiment of another aspect of the invention, a blade lock spans the width of the handle and latches a blade together with both sides of a handle to keep the blade in a desired position.

As yet another aspect of the present invention, the aforementioned blade lock may be used to retain a removable pocket clip or lanyard loop associated with an end of a handle.

In accordance with a further aspect of the invention, a folded outer blade is retained in its folded position in a handle by an interlock or safety catch when a tool such as folding pliers is not in a fully folded position with respect to the handle with which such an outer blade is associated.

The foregoing and other objectives, features and advantages of the invention will be more readily understood upon consideration of the following detailed description taken in conjunction with the accompanying drawings.

BRIEF DESCRIPTION OF THE SEVERAL DRAWINGS

DETAILED DESCRIPTION OF THE INVENTION

Figure 1:
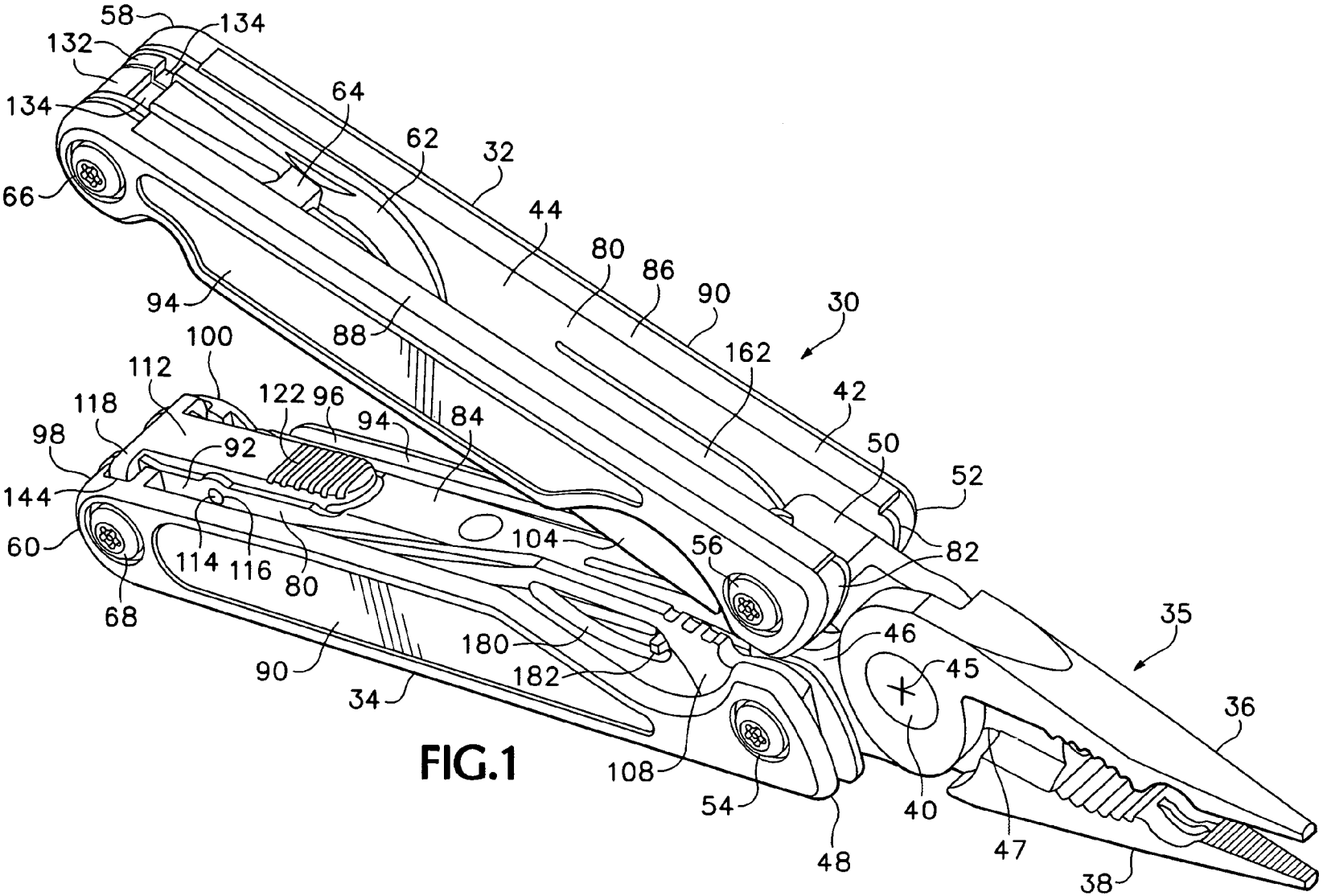
FIG. 1 is an isometric view of a folding multipurpose tool embodying various aspects of the present invention, the tool including a pair of pliers shown in their deployed position.

Referring now to the drawings, which form a part of the disclosure herein, in FIG. 1 a folding multipurpose hand tool 30 includes a pair of handles 32 and 34 and a pair of pliers 35 including jaws 36 and 38 interconnected with each other by a jaw pivot joint 40. Each of the handles 32 and 34 includes a main frame member 42 defining a longitudinal channel 44. It will be understood that either of the handles could also be used independently in a folding tool having only one handle, or in conjunction with a second handle of a different type in a tool having two handles.

The pliers jaw 36 has a base 46 attached to a first, or front end 48 of the handle 34. Similarly, the pliers jaw 38 has a base 50 attached to a first, or front end 52 of the handle 32. The base 46 of the jaw 36 is attached to the handle 34 by a pivot pin 54, and the base 50 of the pliers jaw 38 is attached to the handle 32 by a pivot pin 56. The pliers jaws 36 and 38 are movable between the deployed position shown in FIG. 1 and a stowed position shown in FIG. 2, by pivoting the handles 32 and 34 with respect to the pliers jaws 36 and 38, about the blade or tool pivot pins 54 and 56.

Figure 2:
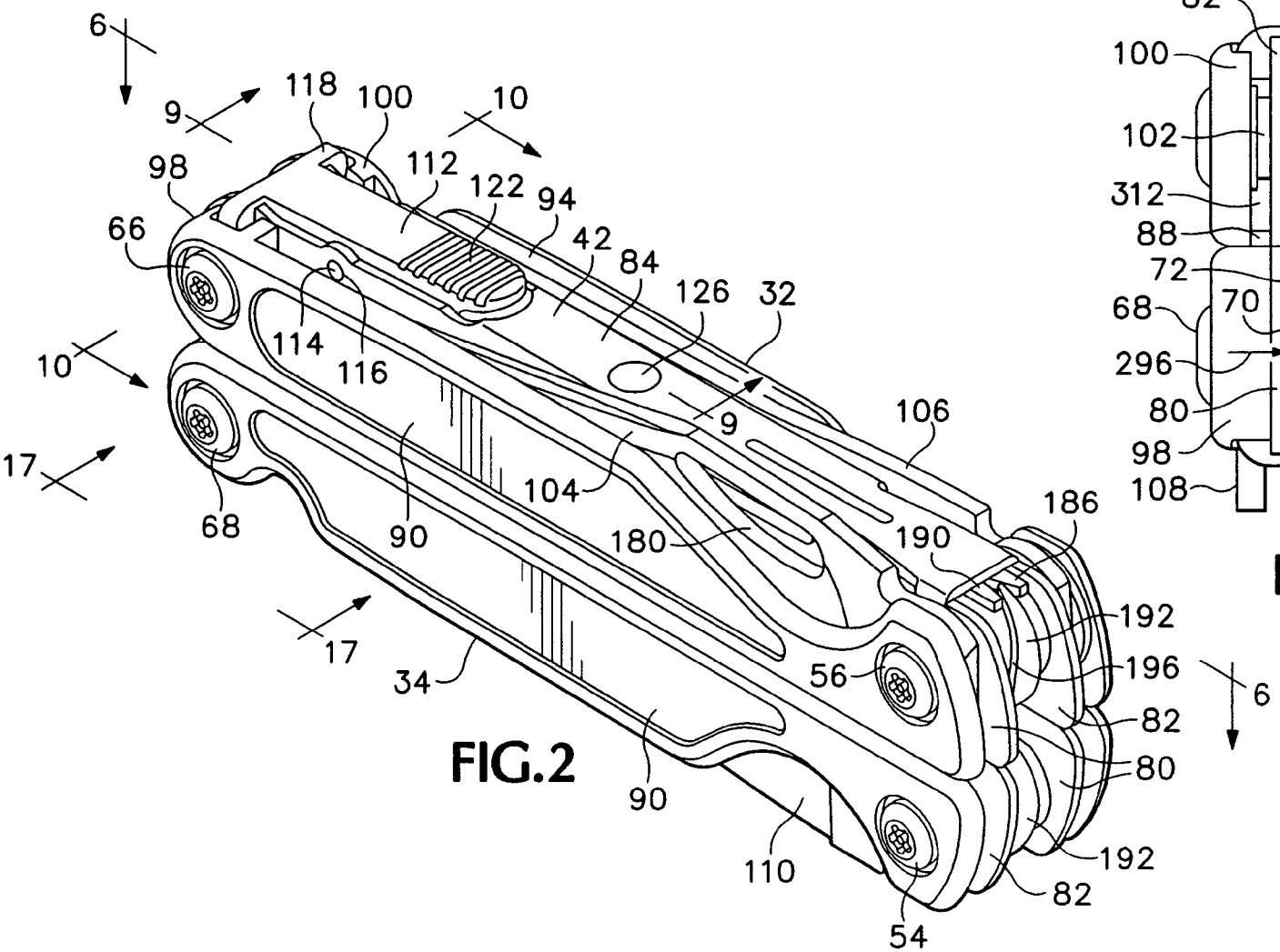
FIG. 2 is an isometric view from the opposite side of the folding multipurpose tool shown in FIG. 1, with its handles folded and the pliers shown in their stowed position within and between the handles of the tool.

With the tool 30 in the folded configuration shown in FIG. 2, the pliers 35 are stowed between the handles 32 and 34 and within tool stowage cavities defined by the channels 44.

It will be understood that instead of the pliers 35, the folding multipurpose tool 30 might include other pivotally interconnected cooperative tool components, such as other types of pliers or scissors-action cutting tools interconnected by a pivot joint corresponding to the jaw pivot joint 40. It will also be understood that a unitary tool member such as a special purpose wrench (not shown) might also be interconnected to both of the handles 32 and 34 by the pivot pins 54 and 56 or be connected to the front ends 48 and 52 by other mechanisms (not shown).

In a preferred version of the pliers 35, the jaw pivot joint 40 includes a pair of approximately elliptical oval hubs 41, oriented across the length of the pliers jaws 36 and 38. The width 43 of the hubs is thus greater than the dimension of the hubs in the direction parallel with the length of the jaws 36 and 38, preferably by a ratio of about 4:3 and more preferably by a ratio of about 5:3. The pivot joint 40 has a pivot axis 45 centered in the hubs 41. As a result, while the jaws have ample strength resulting from the amount of material on each side of the pivot axis 45, in the direction of the width 43, the throat 47 of the jaws is relatively close to the pivot axis 45, so that the mechanical advantage available to produce force in the throat 47, for wire-cutter scissors action, for example, is significantly greater than for pliers or other scissors-action tools of similar size utilizing conventional round or longitudinally-oriented non-circular hubs capable of sustaining the same forces from the handles of a tool.

Figure 3:
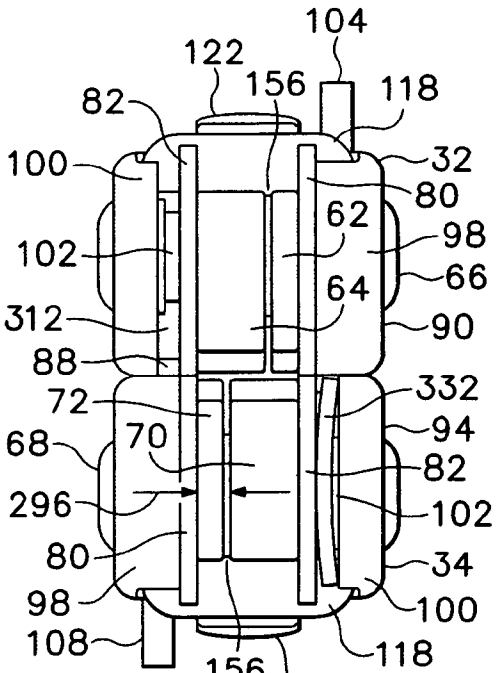
FIG. 3 is an outer, or blade, end elevational view of the folded multipurpose tool shown in FIG. 2, taken from the left end of the tool as shown in FIG. 2.
Figure 4:
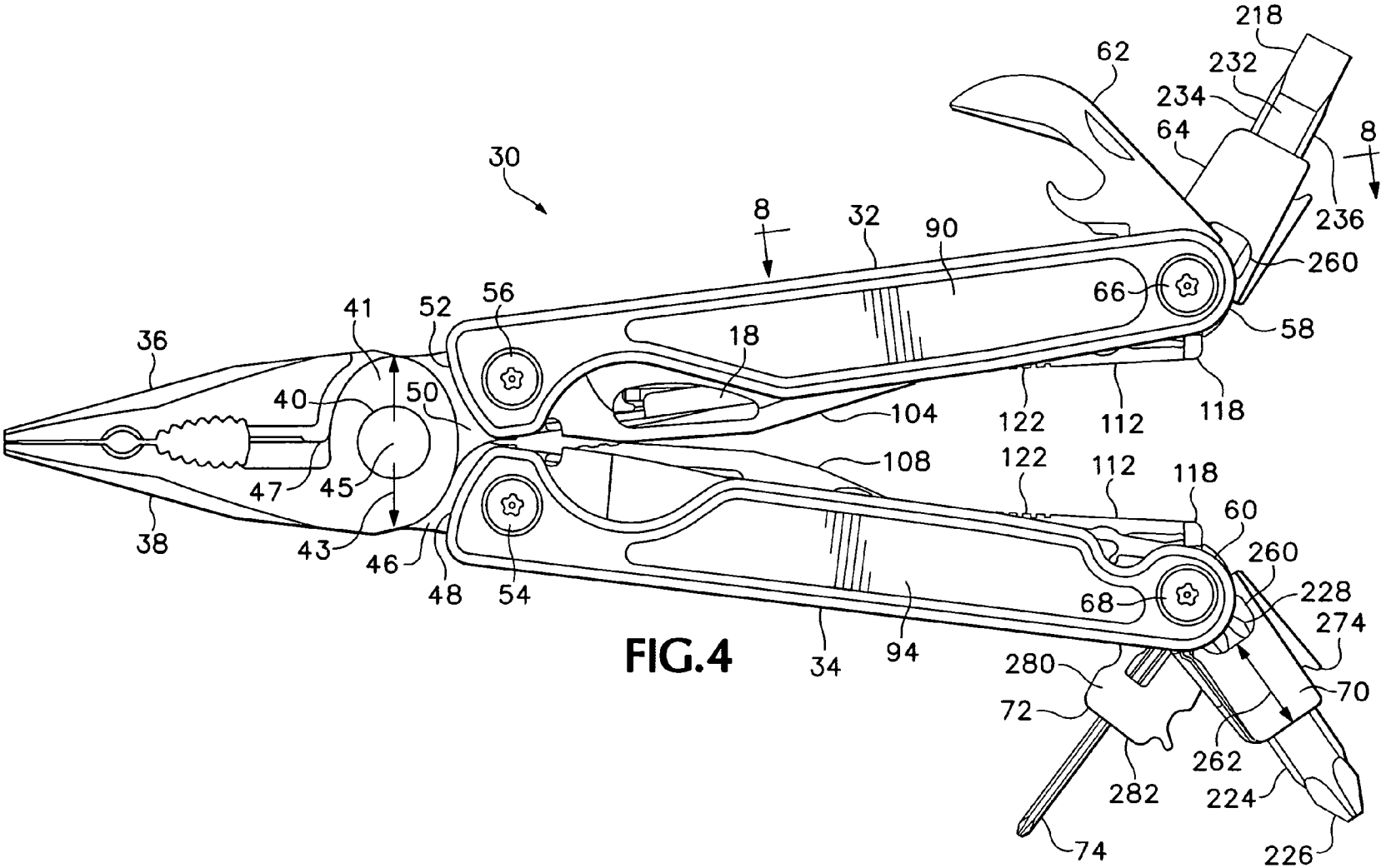
FIG. 4 is a side elevational view of the tool shown in FIG. 1, taken from the side opposite the one shown in FIG. 1, with a tool member and tool bit holders shown in intermediate positions between folded and extended positions thereof.

Referring also to FIGS. 3 and 4, the handle 32 has an outer end 58, and the handle 34 has an outer end 60. A can opener 62 and a tool bit holder 64 are attached to the handle 32 at its outer end 58 by a pivot pin 66.

A pivot pin 68 is similarly located at the outer end 60 of the handle 34 and a tool bit holder 70, similar to the tool bit 64, is attached to the handle 34 by the pivot pin 68. A tool bit holder 72 particularly adapted to hold relatively slender tool bits, such as the very slender tool bit 74, is also attached to the outer end 60 by the pivot pin 68. Both of the tool bit holders 70 and 72 are in their folded positions within the channel 44 defined by the main frame member 42 of the handle 34, as the tool is shown in FIGS. 1, 2, and 3.

The handles 32 and 34 are of similar construction. The main frame member 42 of each is preferably of formed sheet metal, such as sheet stainless steel, and includes a pair of opposite channel side walls 80 and 82, a channel base or bottom portion 84, and a pair of side flanges 86 and 88 that extend outwardly away from the channel 44 at the outer or top margin of each of the channel sides 80 and 82. A handle side plate 90 abuts and extends along the side flange 86, and together with the channel side wall 80 defines an outer channel 92 facing openly in the opposite direction from the central channel 44 defined by the handle main frame member 42. A handle side plate 94 abuts and extends along the side flange 88, parallel with and spaced apart from the channel side 82 of the central channel 44, defining, together with the channel side wall 82 and the flange 88, an outer channel 96 facing in the same direction as the outer channel 92.

The side plate 90 includes a bolster portion 98 closing the outer channel 92 and abutting on the channel side wall 80. Similarly, a bolster portion 100 is included and formed integrally with the handle side plate 94 and extends inwardly across the channel 96 toward the channel side wall 82. A spacer 102 is mounted on the pivot pin 66 or 68 at the outer end of the respective handle, to establish a desired distance between the bolster portion 102 and the channel side wall 82.

Figure 5:
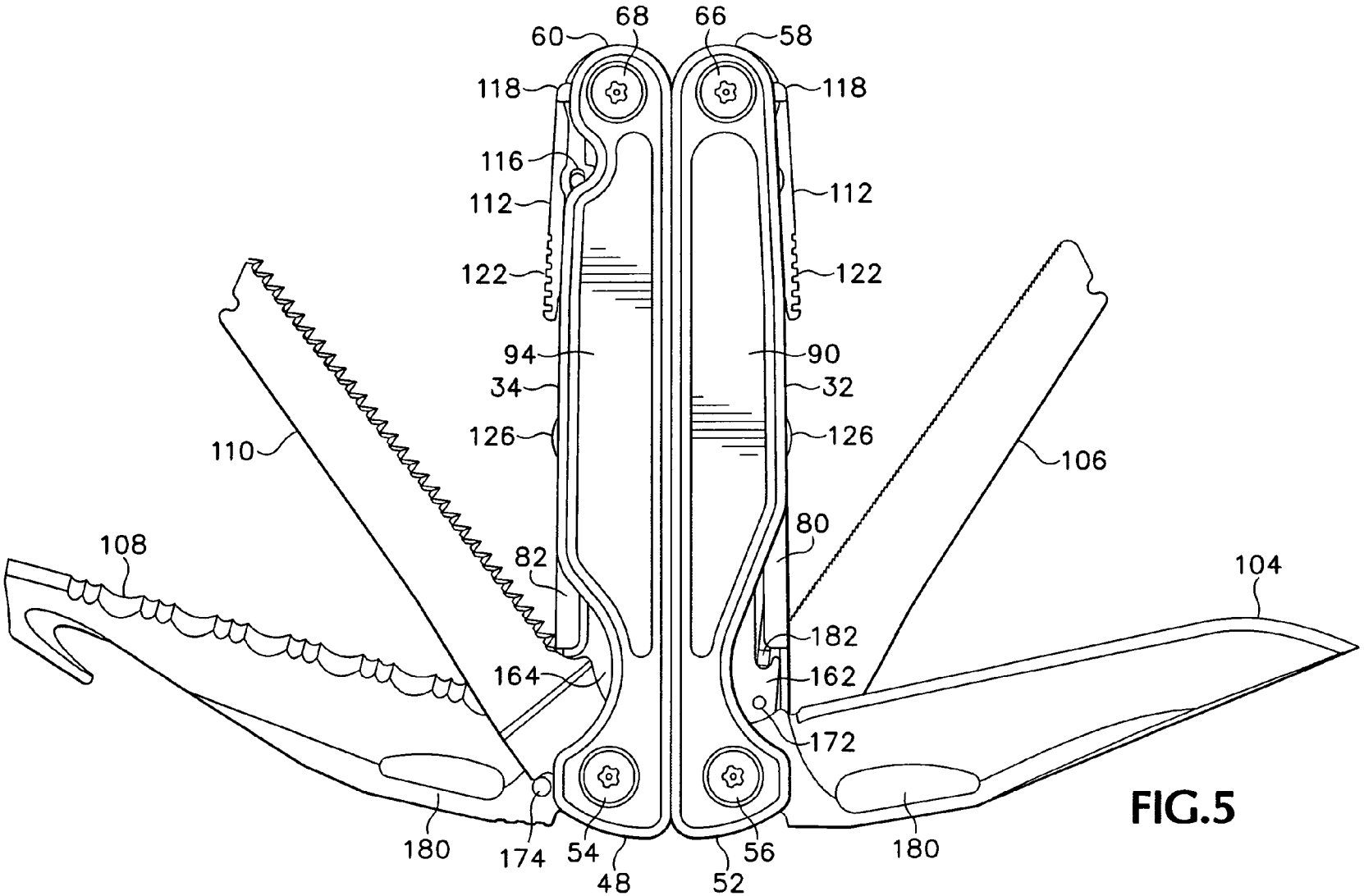
FIG. 5 is a side elevational view of the tool shown in FIGS. 1–4, taken from the side shown in FIG. 2, with various outer blades shown in positions between their folded positions and their extended positions.

As shown best in FIG. 5, outer tool blades are attached to the front end 52 of the handle 32 and the front end 48 of the handle 34. Thus, a knife blade 104 and a file 106 are pivotably attached to the handle 32 by the pivot pin 56, while a knife blade 108 and a small saw 110 are attached pivotally to the handle 34, at its front end 48, by the pivot pin 54.

Blade Latch and Release Mechanism

As shown in FIGS. 6–10, a tool blade member mounted pivotably within a central channel 44 at its outer end 58 or 60 may be held securely in its extended position by the action of a latch mechanism including a latch lever 112 attached to the main frame member 42 of the respective handle by a latch lever pivot. The latch lever pivot includes a pair of trunnions 114 that extend from opposite sides of the lever 112 and are carried in corresponding elongated holes 116 defined in the side walls 80 and 82 near the outer end 58 or 60, establishing a latch lever pivot axis parallel with the pivot pin 66 or 68.

A latch body in the form of a locking bar 118 carried on an outer end of the latch lever 112 extends into a pair of latch support notches 120 defined respectively in the channel side walls 80 and 82. The locking bar 118 preferably is very slightly tapered from a slightly greater thickness adjacent the outer end of the latch lever 112 to a slightly lesser thickness adjacent its bottom face 140, as may be seen in FIG. 9D. A pressure pad 122 at the opposite, or inner, end of the latch lever 112 preferably includes a non-slip surface contour such as several parallel grooves and ridges. The latch lever 112 is preferably cast or formed by metal injection molding methods.

Preferably, the latch lever 112 fits snugly between the opposite side walls 80 and 82 of the central channel 44, and the bottom 84 of the central channel is open far enough to leave ample room for the latch lever 112 to move into the space between the channel side walls 80 and 82 as the latch lever 112 pivots about the latch lever pivot. The latch lever 112 is mounted in the central channel 44 by snapping it into place, i.e., forcing the side walls 80 and 82 apart elastically far enough to allow the trunnions 114 to be placed into the elongated holes 116 and then allowing the sides 80 and 82 to return to their original positions.

A flat spring 124 preferably of sheet metal is securely mounted within the central channel 44, as by a fastener such as a rivet 126 fastening the spring 124 to the channel base 84, although the spring could be mounted in other ways, as well. The spring 124 is in the form of a finger whose tip presses against a bump 128 on the bottom or inner side of the latch lever 112, as shown in FIGS. 6, 7, 8, and 9, urging the latch lever to rotate about the trunnions 114 in a direction urging the locking bar 118 into engagement in the latch support notches 120 in the side walls 80 and 82. As shown in FIG. 8A, a spring 124' could be formed of the material of the channel base 84.

A base portion 130 of the tool bit holder 64 has a peripheral surface 132, which is preferably arcuate over a portion subtending an angle of about 145 degrees about the central axis of the pivot pin 66. A latch engagement notch 134 is defined in the base 130, in a position aligned with and between the latch support notches 120 when the tool bit holder 64 is in its desired extended position, as shown in FIG. 9.

Figure 9:
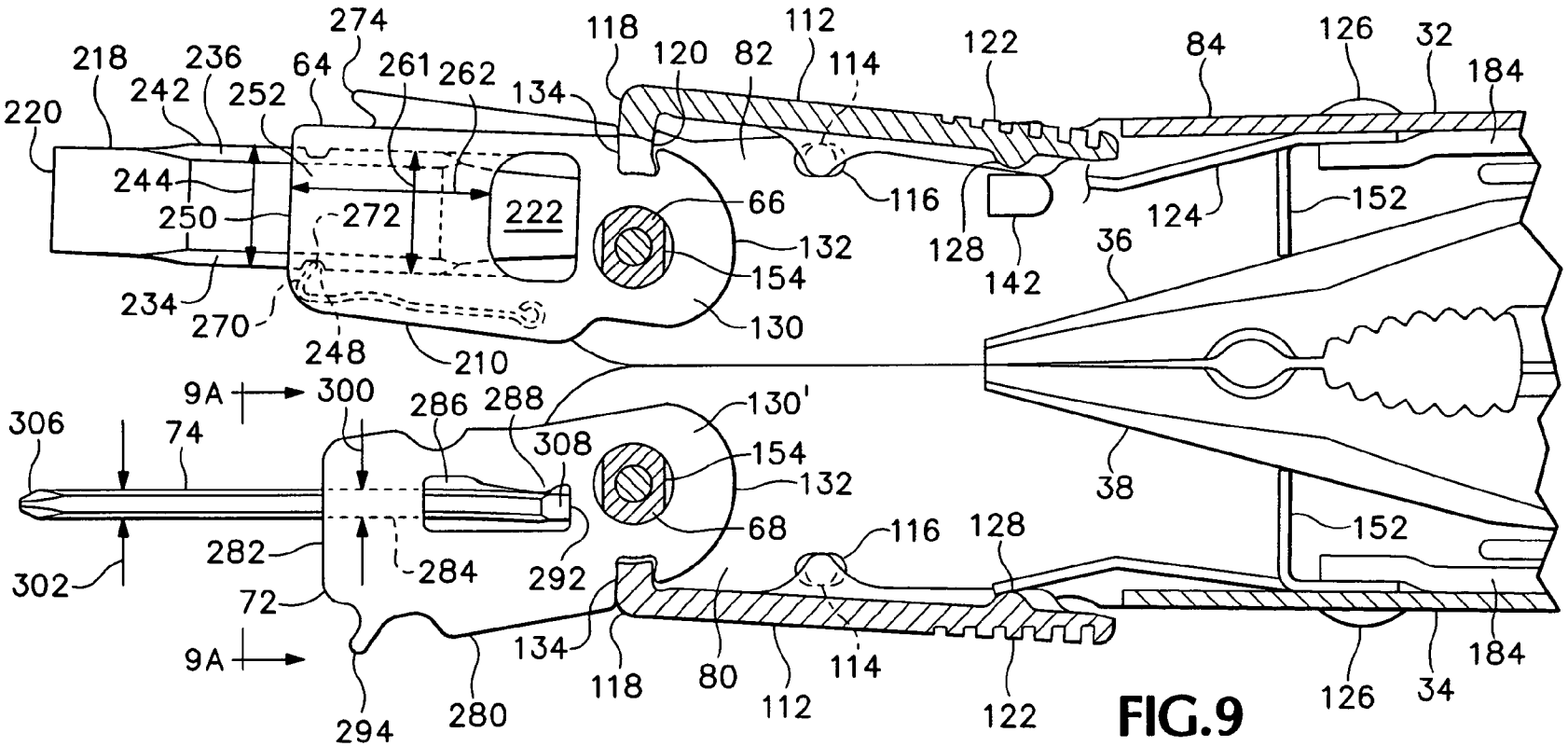
FIG. 9 is a sectional view of a portion of the folding multipurpose tool shown in FIG. 2, taken along the line 9—9, and showing folding tool bit holders in their extended positions.
Figure 9A:
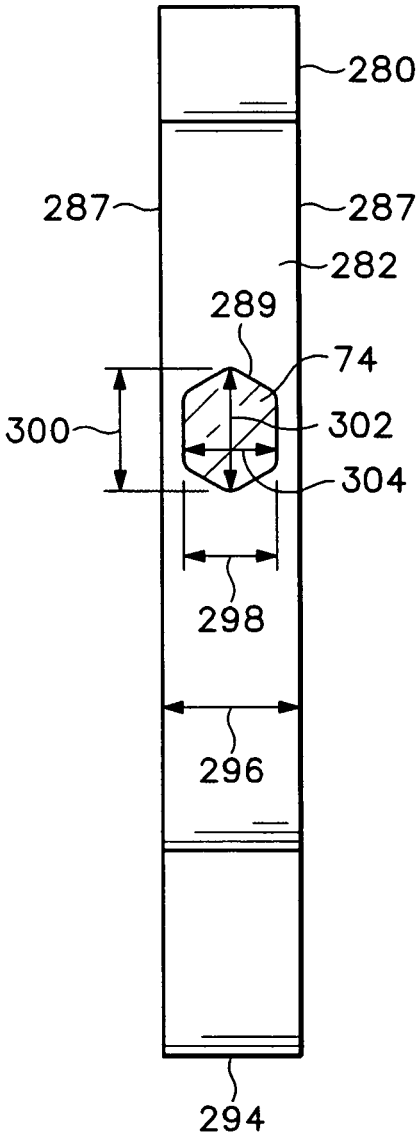
FIG. 9A is an end elevational view taken along line 9A—9A in FIG. 9, showing a tool bit holder and a slender tool bit carried therein.
Figure 9B:
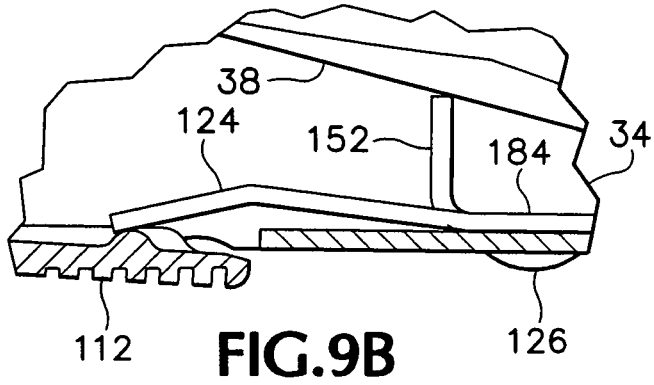
FIG. 9B is a view similar to a portion of FIG. 9 showing an alternative spring for the latch lever.
Figure 9C:
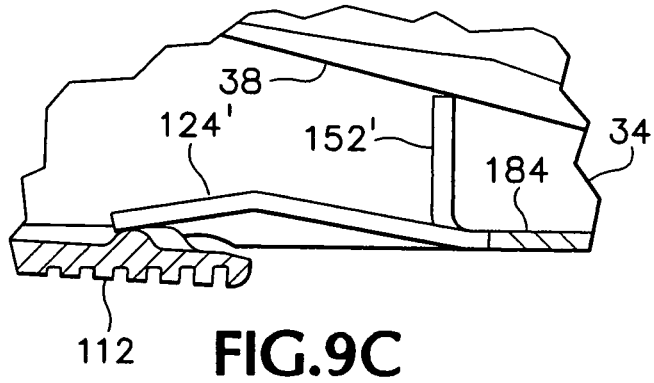
FIG. 9C is a view similar to FIG. 9B showing the spring arrangement depicted in FIG. 8A.
Figure 9D:
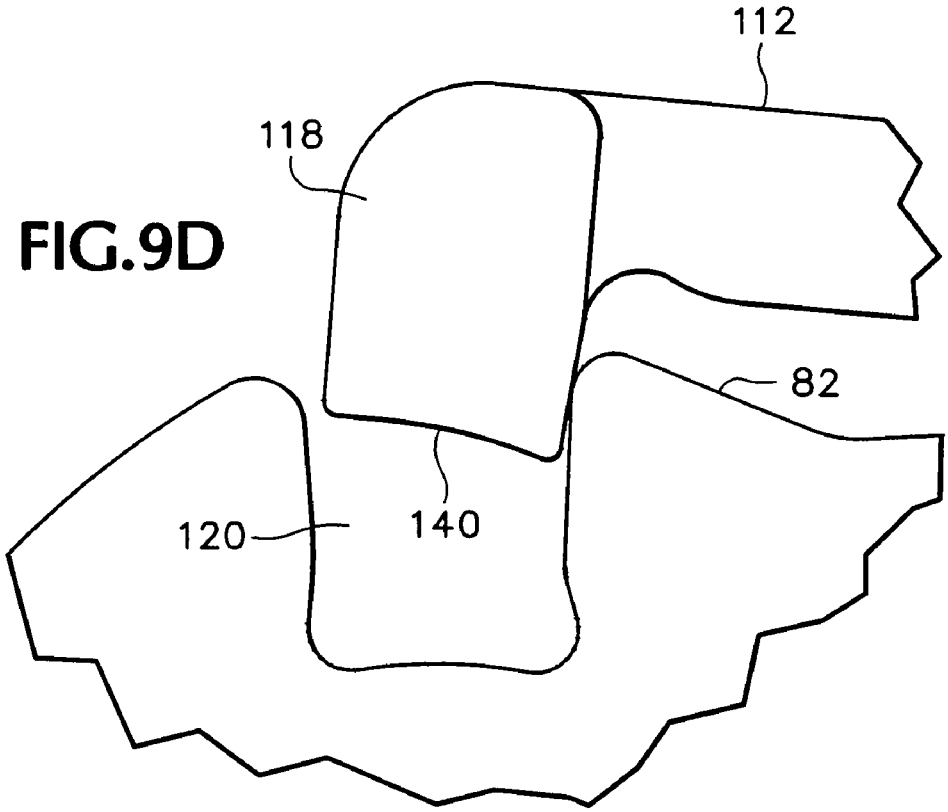
FIG. 9D is a detail view showing a portion of a side wall defining a latch supporting notch, together with a locking bar in a raised position.
Figure 9E:
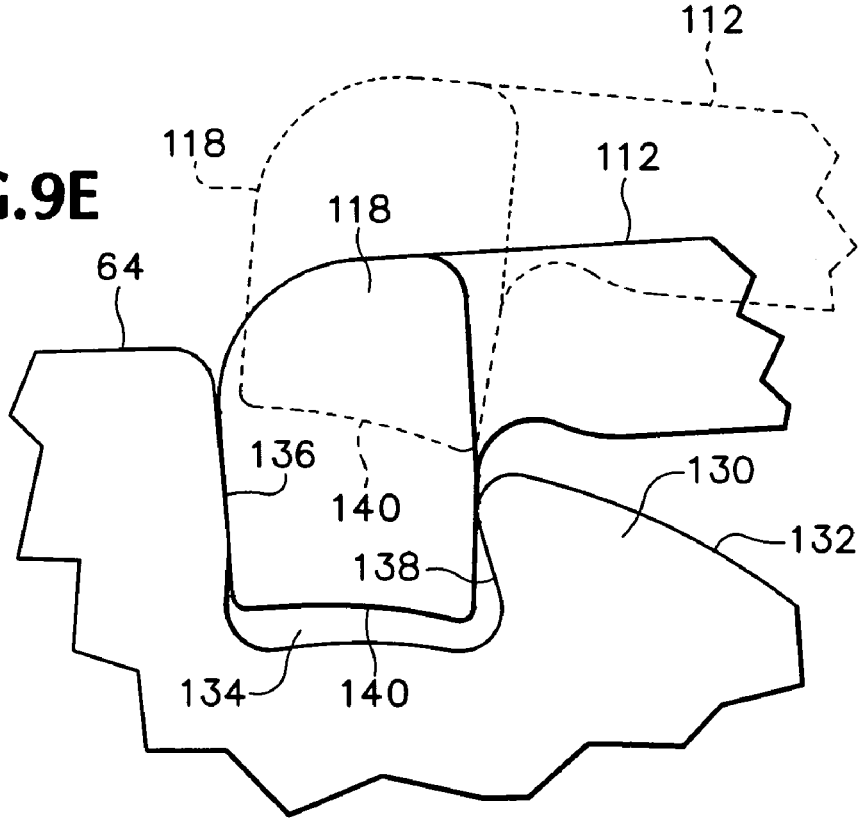
FIG. 9E is a detail view of a locking bar engaged in a locking notch in a base portion of a folding tool blade.

A forward, or abutment wall 136 of the latch engagement notch 134, is higher than a rear wall 138, so that when the locking bar 118 is raised to the position shown in FIG. 9 and shown in the broken line in FIG. 9E with respect to the base 130 of the tool bit holder 64, there is sufficient clearance to permit the peripheral surface 132 to pass beneath the bottom face 140 of the locking bar 118, so that the tool bit holder 64 can be rotated about the pivot pin 66 toward its folded position within the center channel 44.

The range of movement of the latch lever 112 about the trunnions 114 is limited, however, by a latch lever stop 142 extending into the central channel 44 from the side wall 82 of the channel. The limit stop 142 may be made by partially piercing and bending inward a portion of the side wall 82, for example. It obstructs movement of the latch lever 112 in such a position that the locking bar 118 cannot be disengaged fully from the latch support notches 120, as shown in the handle 32 in FIG. 9. The locking bar 118 thus is prevented from moving out from the latch support notches further than the position shown in FIG. 9D.

The limit stop may take other forms, as well, such as by being formed as a portion of the bottom 84 of the central channel to extend beneath the latch lever 112 at the appropriate position, or by being included in the latch lever 112 as a part extending above the outer surface of the bottom 84 so as to engage it when the latch lever 112 is fully depressed and thereby prevent the locking bar 118 from being raised to a position completely clear of the latch support notches 120 in the side walls 80 and 82.

The front or abutment wall 136 of the latch engagement notch 134 is high enough so that with the latch lever 112 in its fully depressed position as limited by the limit stop 142, the locking bar 118 continues to confront or bear upon the abutment wall 136 to oppose rotation of the tool bit holder 64 in a clockwise direction as seen in FIG. 9. The locking bar 118 thus obstructs movement of a tool member such as the tool bit holder 64 in an extending or opening direction, and the locking bar 118 is at the same time supported by the portions of the channel side walls 80 and 82 defining the latch support notches 120. Thus the locking bar 118 can never be raised to a position freeing a folding tool member such as the tool bit holder 64 to rotate beyond its intended extended position.

The latch support notches 120 preferably are shaped and made of a size to receive the locking bar 118 snugly but extending at least nearly to the full depth of the latch support notches 120. The trunnions 114 are free to move longitudinally a small distance with respect to the side walls 80 and 82 as a result of the elongated form of the holes 116, so that the locking bar 118 is free to float to a position in which it reaches snug engagement simultaneously in the latch support notches 120 of both side walls as well as in the latch engagement notch 134 of an extended tool blade. Because of the location of the elongated holes 116 and the cooperative shapes of the latch support notches 120 and the locking bar 118, the trunnions 114 are not subjected to the forces resulting from use of the outer tool blades, and those forces are transmitted through the locking bar 118 to the surfaces of the side walls 80 and 82 defining the latch support notches 120.

At the same time, the elongated holes 116 afford only minimal clearance for the trunnions 114 in the direction normal to the length of the holes 116 and thus hold the trunnions 114 snugly against undesired looseness in an up or down direction with respect to the side walls 80 and 82.

The latch engagement notch 134 in a tool base 130 is preferably shaped to contact the locking bar 118 at the mouth of the latch engagement notch 134, and along the front wall 136. As seen in FIG. 9E, the engagement notch 134 is slightly tapered so that the bottom of the notch 134 is slightly wider and may include radiused corners, to facilitate manufacturing, while the notch shape results in snug latching action between the locking bar 118, the latch support notches 120, and the latch engagement notch 134 in the base 130, to minimize free play in an extended tool blade such as the tool bit holder 64.

When the spring 124 is allowed to rotate the latch lever 112 about the trunnions 114, the locking bar 118 is carried into the latch engagement notch 134 of an extended tool, such as the notch 134 in the base of the tool bit holder 72 attached to the handle 34, as shown in FIG. 9. The locking bar 118 is thereby engaged fully in the latch engagement notch 134 in the base 130 of the tool bit holder 72, with the front wall 136 and the rear wall 138 both engaged by the locking bar 118. This prevents the tool bit holder 72 from rotating too far about the pivot pin 68, either in the direction toward its extended position or toward its folded position within the channel 44.

Figure 6:
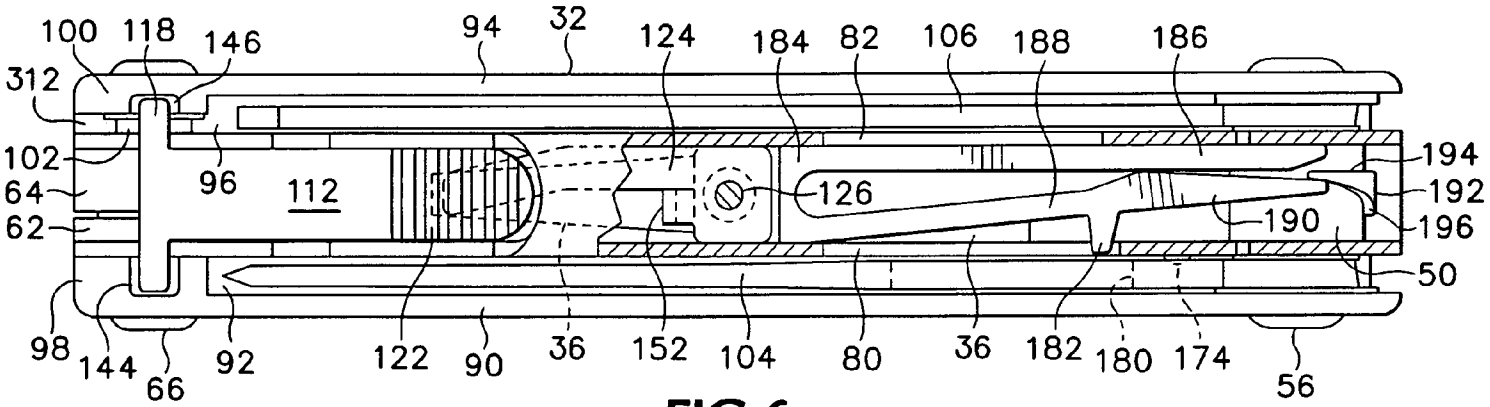
FIG. 6 is a partially cutaway view of the folding multipurpose tool shown in FIGS. 1–5, taken in the direction indicated by the line 6—6 in FIG. 2.
Figure 7:
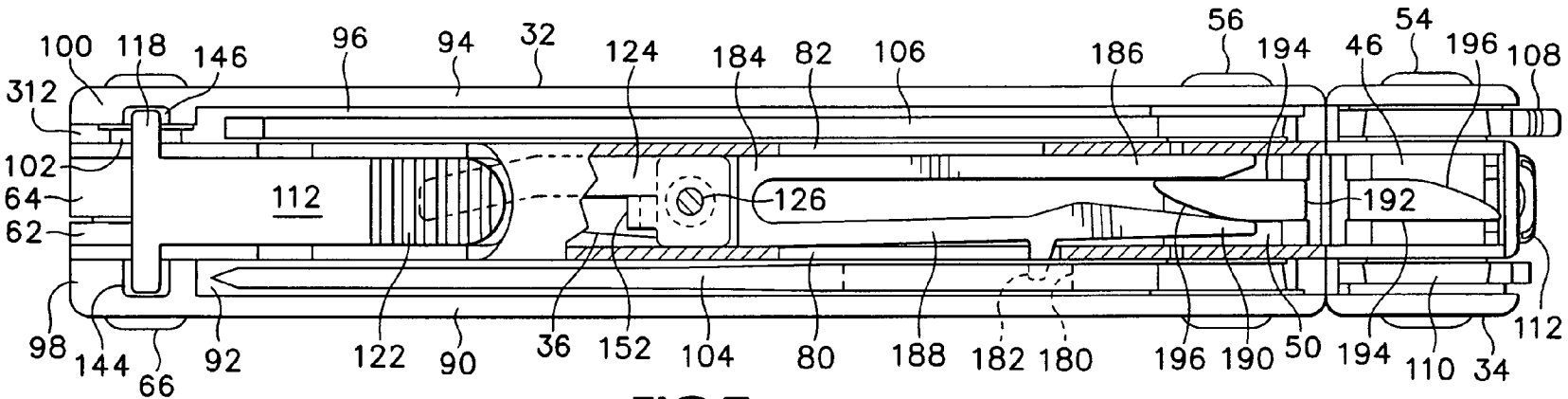
FIG. 7 is an elevational view taken in the same direction as FIG. 6, but in which one of the handles, together with the pliers, has been pivoted 90 degrees with respect to the other handle.

Not only does the locking bar 118 extend into engagement in the latch support notches 120, but it also extends into a latch support notch extension 144 defined in the bolster portion 98 of the side plate 90 and a latch support notch extension 146 defined in the bolster portion 100 of the side plate 94, as can be seen most clearly in FIGS. 6 and 7. While the latch support notches 120 defined in the channel side walls 80 and 82 receive the locking bar 118 snugly, the support notch extensions 144 and 146 may be larger and loosely receive the outer ends of the locking bar 118.

As may be seen in FIGS. 6, 7, 8, and 9, a post 152 is formed from a portion of the material defining the spring 124. As shown in FIG. 8A a post 152' could be formed of the material of the channel base 84. The post 152 extends upwardly within the central channel 44 from the base portion of the spring 124 to guide and support each of the pliers jaws 36 and 38 within the central channels 44, so that the pliers jaws 36 and 38 are not moved into a position within the channels 44 of the handles 32 and 34 where the pliers would interfere with a folding tool member such as the can opener 62 or one of the tool bit holders 64, 70, and 72.

Figure 10:
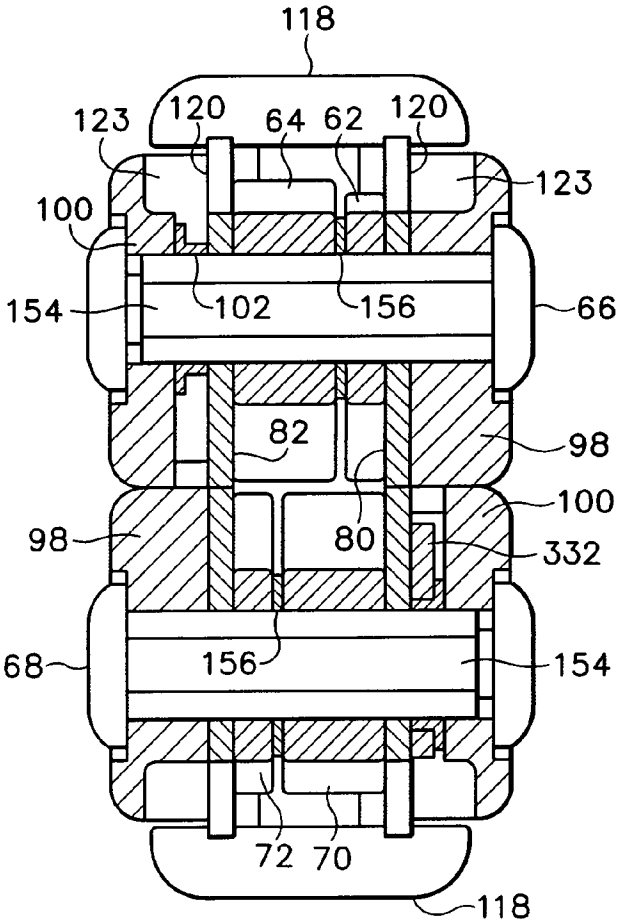
FIG. 10 is a sectional view taken along line 10—10 in FIG. 2, at an enlarged scale, with the blade latches disengaged.
Figure 11:
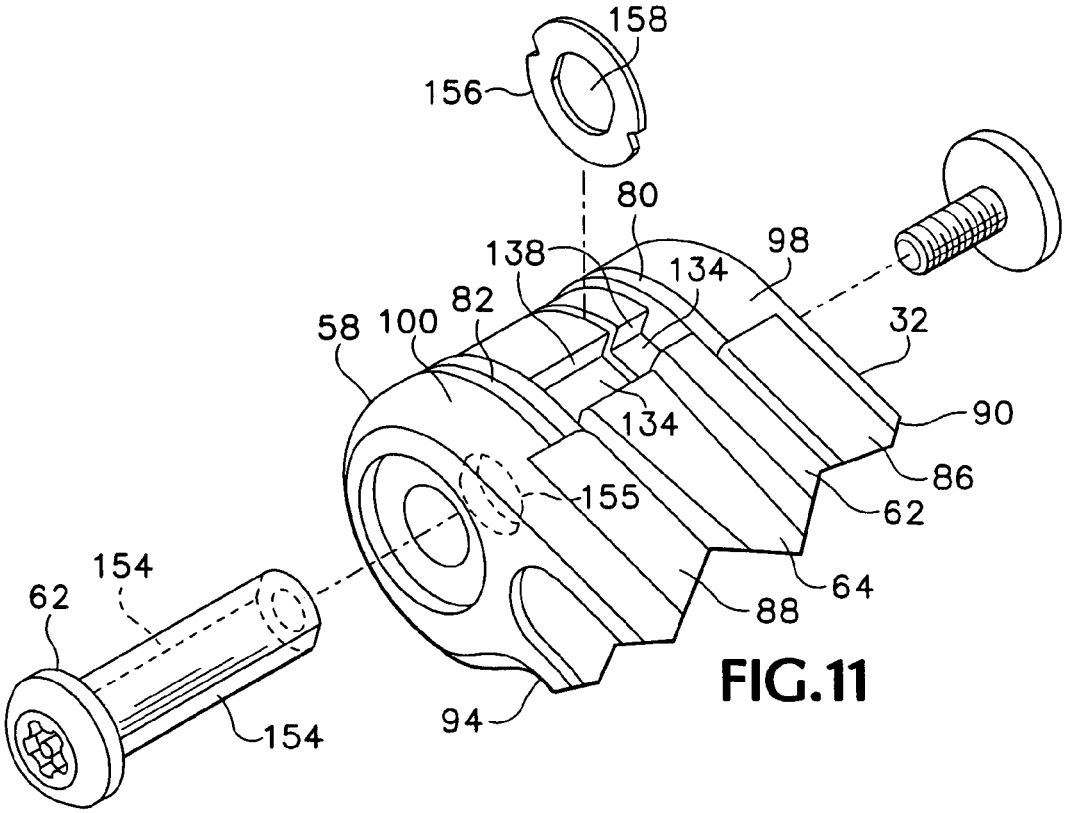
FIG. 11 is a partially exploded isometric view, at an enlarged scale, of the outer end of the upper one of the handles of the tool as shown in FIG. 1.

Referring to FIGS. 9, 10, and 11, the pivot pins 66 and 68 may be screw fasteners adjusted to hold the bolster portion 98 snugly against the channel side wall 80 and to hold the spacer 102 snugly between the bolster portion 100 of the side plate 94 and the outer side of the channel side wall 82, and to urge the side walls 80 and 82 toward each other and the bases 130 of any folding tool members contained in the central channel 44 of the particular handle. Because the side pressure between adjacent ones of the bases 130 of folding tool members might otherwise result in movement of more than one of such folding tool members together about the respective pivot pin 66 or 68, each pivot pin 66 or 68 has a non-circular shape such as including a pair of opposed flats 154, and is fitted in a correspondingly shaped hole 155 formed in one of the side walls 80 or 82 or one of the side plates 90 or 94 to prevent the pivot pin from rotating. A thin spacer 156 in the form of a washer is located between adjacent bases 130. The spacer 156 includes a central opening 158, which fits non-rotatably on such a pivot pin 66 or 68. The spacer 156 isolates the bases 130 of adjacent folding tool members such as the tool bit holder 64 and the can opener 62 from each other, so that such adjacent folding tool members are not dragged along by one another when one is being moved from its folded position within the central channel 44 toward its extended position with respect to the handle 32 or 34.

Outer Blade Lock and Interlock

With the folding multipurpose tool 30 in the folded configuration shown in FIG. 2, any one or more of the outer blades 104, 106, 108, and 110 can be opened, by being pivoted outwardly about the pivot pin 54 or 56 from its respective stowed position within one of the outer channels 92 and 96. The channel side wall 80 defines an outwardly biased blade locking portion 162, and the channel side wall 82 includes a similar outwardly biased blade locking portion 164 to engage respective locking faces on the bases of the outer blades 104, 106, 108, and 110, to retain a respective one of the blades in its fully extended position.

Figure 12:
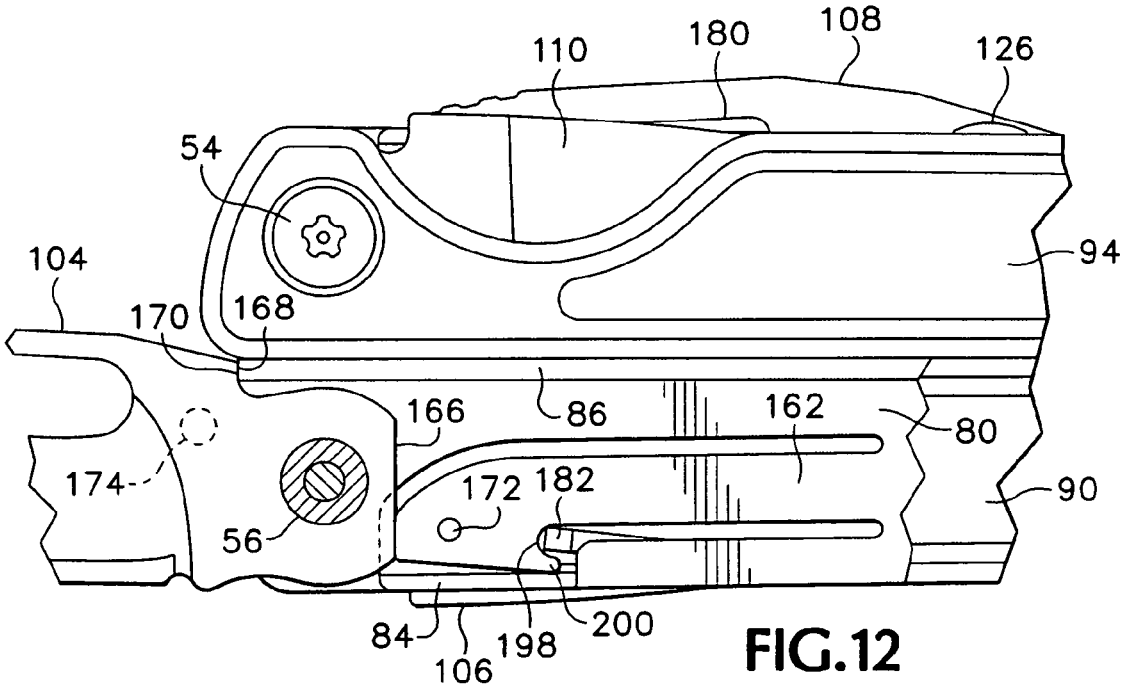
FIG. 12 is a partially cutaway view of the tool shown in FIGS. 1–5, taken in the same direction as FIG. 5, with the handles in the configuration shown in FIG. 5 and with one outer blade in an extended position.

For example, the clip point knife 104 is shown in its fully extended position in FIG. 12, with the locking body of the liner lock 162 engaged with the locking face 166 on the base of the knife blade 104. An abutment face 168 is defined adjacent the back of the knife blade 104 and rests against a limiting face 170 defining an outer end of the flange 86 that defines the bottom of the outer channel 92. The blade locking portions 162 and 164 are elastically biased outward away from the interior of the central channel 44, so as to engage the locking face 166 of a respective one of the outer blades as soon as the blade reaches its fully extended position with respect to the handle 32 or 34.

A detent, such as a bump 172 on the outer face of the blade locking portion 162, is located so as to extend into a dimple 174 defined in the opposing face of each outer blade such as the knife 104, and normally retains the blade in its folded position. Such a detent is relatively easily overcome by the user in attempting to open the outer blade. Thus, were that detent combination the exclusive means of retaining a sharpened blade such as the knife blades 104 and 108, it would be possible for one of those blades to be opened from its folded position when the pliers 35 or other tool also mounted on the front end 52 of the handle 32 or the front end 48 of the handle 34 is open. Since there is ordinarily no reason to have such a sharpened blade as the knife 104 or 108 opened from its folded position during use of the pliers 35, for example, a safety interlock mechanism is provided to prevent one blade from moving from its folded position relative to a handle, in response to a tool member also associated or connected with that handle being in a position other than a particular first position. Such an interlock mechanism is provided in each of the handles 32 and 34, respectively, to engage the knife blades 104 and 108 and retain them in their folded positions in the outer channels 92 and 96 whenever the pliers 35 or another correspondingly mounted tool is deployed with respect to the handles 32 and 34.

The knife blades 104 and 108 both define holes 180 extending through their blades to be engaged by a user's thumb or finger to push the blades open from their folded positions in the outer channels 92 and 96. An interlock catch in the form of a latch finger 182, however, extends into the hole 180 of respective blade 104 or 108, preventing the blade from being opened outwardly from its folded position whenever the base of the tool housed in the central channel 44 of the particular handle 32 or 34 is moved at least a predetermined distance away from its fully stowed position within the central channel of the handle. It will be understood that for outer blades that have no holes extending entirely through them as do the holes 180, a suitable blind hole or ledge could be provided to be engaged by the finger 182, or the finger 182 could be located so as to engage the back of a blade.

Referring again to FIGS. 6 and 7, a fork-like spring 184 is attached to the bottom 84 of the central channel 44 by the rivet 126. Instead of being a separate piece as shown in FIGS. 6 and 7, the spring 184 could be integrated with the spring 124 and the finger 152, as shown in FIG. 9B.

A first prong 186 of the spring 184 extends within the channel 44 alongside the side wall 82 and closely along the channel base 84. A second prong 188 of the spring 184 has a tapered outer end 190 and carries the interlock latch finger 182.

A cam 192 extends around part of the base portion 50 of the pliers jaw 38. The cam 192 has a flat side 194 facing toward and oriented generally parallel with the channel side wall 82. The opposite side of the cam 192 is sloped with respect to the flat side 194, with a generally helical surface 196 centered on the pivot pin 56. When the folding tool 30 is in its folded configuration as shown in FIGS. 2 and 6, the tapered outer end 190 of the second prong 188 of the latch spring 184 rests against the helical surface 196 at the narrowest portion of the cam 192, and the outermost portion of the interlock latch finger 182 does not extend substantially beyond the outer side of the channel side wall 80. That is, the latch finger 182 does not extend far enough into the outer channel 92 in which the knife blade 104 is located in its folded position to interfere with movement of the knife blade 104. Except for the engagement of the detent bump 172 in the dimple 174, the knife blade 104 is thus free to be moved from within the outer channel 92 to its extended position.

When the handle 32 is moved away from the folded configuration of the multipurpose tool 30, so that the base 50 of the pliers jaw is pivoted with respect to the handle 32 about the pivot pin 56 away from the position shown in FIG. 6 and toward the position shown in FIG. 7, the cam surface 196 moves with respect to the tapered outer end 190. As the tapered end 190 follows the cam surface 196, the second prong 188 of the forked spring 184 carries the latch finger 182 laterally outward away from the interior of the central channel 44, so that it extends into the interior of the hole 180 in the blade of the knife 104 as soon as the base 50 of the pliers jaw has moved more than a very few degrees away from its folded position within the handle 32.

It will be understood that other cam arrangements are also possible to carry the latch finger 182 or an equivalent into a place of engagement with a folding outer blade in response to movement of a pair of pliers or other tool member away from a stowed position in the central channel 44. For instance, a finger might extend from the second prong 188 into a suitably located groove defining a cam. Such a groove might be defined in the base portion 46 or 50 of a pliers jaw 36 or 38 instead of the cam 192 shown herein. A corresponding cam that could be followed by such a finger might also be defined in a sliding portion of a tool member which rather than being pivoted, moves longitudinally in a handle 32 or 34 to or from its stowed position within the central channel 44.

Rather than being carried on a prong 188 of a forked spring, the latch finger 182 or its equivalent could be carried on a lever (not shown) arranged to pivot about a fulcrum attached to the interior of the central channel 44. Other arrangements would also be feasible, with the key requirement being that a latch finger be forced to move in response to movement of a tool away from its normal stowed position within the central channel.

An identical forked spring 184 is present in the handle 34 to retain the blade 108 in its closed position when the handle 34 is moved with respect to pliers jaws by pivoting about the pivot pin 54. Thus, so long as the folding multipurpose tool 30 is in the folded configuration as shown in FIG. 2, either of the knife blades 104 and 108 can be opened, but when either of the handles 32 and 34 is moved away from the folded configuration of the tool 30, and particularly when the handles are extended with respect to the pliers 35 or other tool mounted at the front end of the central channel 44 of either handle 32 or 34, the sharp edged blades housed in the outer channels 92 are interlocked into their folded positions with respect to the handles.

As seen in FIG. 12, the liner lock portion 162 of each side wall 80 is shaped to provide a C-shaped space 198 through which the respective interlock latch finger 182 can extend from within the central channel 44 into the outer channel 92, and a finger 200 is provided in an appropriate location to support the latch finger 182, should someone attempt to move the blade 104 from its folded position within the outer channel 92 when the pliers are not fully stowed.

The first prong 186 of the fork-like spring 184 rides along the flat side 194 of the cam 192 and acts through the base portion of the spring 184 to pull the second prong 188 into the center channel 44 as the base of the tool housed in the central channel 44 of the particular handle is moved back to its fully stowed position within the central channel 44. Additionally, the first prong 186 presses radially inward toward the pivot pin 54 or 56 and against the base 46 or 50 of the respective pliers jaw 36 or 38 so as to urge the respective jaw by cam action to remain in either a fully extended or fully stowed position and to provide friction to resist movement between the fully extended and fully stowed positions.

Tool Bit Holder and Interchangeable Bits

Figure 13:
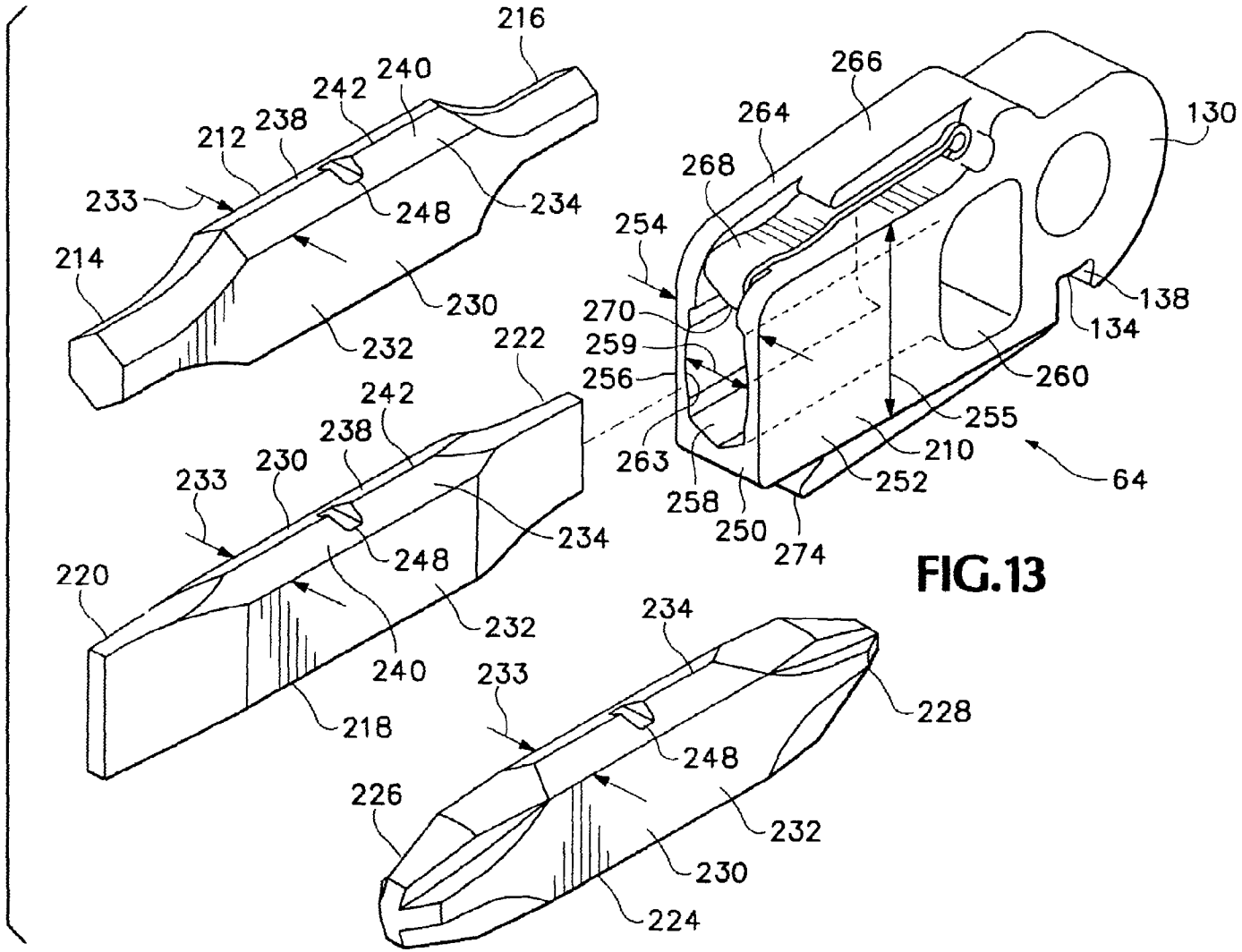
FIG. 13 is an isometric view of a tool bit holder such as one of those shown in FIG. 9, together with three double-ended tool bits designed for use therewith.

Returning to FIGS. 4 and 9, and also referring now to FIG. 13, tool bit holders 64 and 72 are mounted at the outer, or blade, ends of the handles 32 and 34, so that they can be extended and latched into their extended positions, as shown in FIG. 9, or folded by pivoting their bases 130 about a respective one of the pivot pins 66 and 68, through intermediate positions as shown in FIG. 4, to folded positions within the central channel 44 of the respective handle 32 or 34. The tool bit holder 64 has a body 210 that may be machined or manufactured by metal injection molding methods, and that receives and can securely hold and drive compact tool bits designed to mate with various screw heads and other fasteners of different sizes.

For example, a bit 212 includes a working portion such as a first driving end 214 adapted to fit into a hexagonal socket of a first standard size and an opposite driving end 216 that is also hexagonal but of a smaller standard size. A tool bit 218 has straight blade screwdriver tips 220 and 222 of different sizes. A tool bit 224 has a pair of opposite ends 226 and 228 including Phillips screwdriver tips of different sizes. The smaller Phillips screwdriver bit 228 is essentially complete; however, the larger Phillips screwdriver bit 226 is reduced in width, with one pair of opposite arms of the cruciform tip of the bit reduced from the usual size while the other pair are of normal configuration.

Each of the tool bits 212, 218, and 224 includes a base or driven body portion 230 between its two opposite driving outer end portions 214, 216, etc. Each central driven body or base portion 230 has a pair of relatively wide parallel opposite sides 232. The parallel sides 232 mirror each other on opposite sides of each tool bit 212, 218, 224, etc. and are preferably substantially flat and separated by a thickness 233 which is great enough so that the tool bit has sufficient stiffness and strength, but the thickness 233 is significantly less than the across flats dimension of the corresponding regular hexagonal shape. Preferably the thickness 233 is no more than one half the corresponding nominal across-flats dimension.

The parallel flat sides 232 are interconnected with each other by relatively narrow margin portions 234 and 236 which each preferably include narrow flat surfaces 238 and 240 that intersect each other with an included angle of about 120 degrees. Similarly, each of the flat surfaces 238, 240 preferably intersects the adjacent flat side 232 with an included angle of about 120 degrees. Opposite edges 242 defined by the intersections of the flat surfaces 238 and 240 with each other along each of the margins 234 and 236 are separated by a height 244 (FIG. 9) which may be about 9/32 inch in order that the bit 212, 218, 224, etc., can fit snugly within a standard hexagonal socket whose size is nominally ¼ inch across flats. A notch 248 is defined in each margin 234 and 236.

The thickness 233 separating the parallel flat sides 232 from each other is significantly less than the height 244, and preferably is about ⅛ inch, although it could be as little as 0.075 inch. As a result, the tool bit holder 64 can be made narrow enough to fit easily in a handle such as the handles 32 and 34, and several tool bits such as the bits 212, 218, and 224 can be carried in a much smaller space than required by the corresponding tool bits with conventional regular hexagonal shanks.

The body 210 of the bit holder 64 has a second, outer end 250 opposite its base 130. The body 210 also has a pair of flat opposite sides 252 parallel with each other and extending from the outer end 250 toward the base 130. The opposite sides 252 are separated from each other by a thickness 254 that is greater than the thickness 233 of the tool bit, and may, for example, be 0.198 inch. The thickness 254 is thus significantly less than it would have to be were the bit a regular hexagon with a thickness 233 across flats equal to ¼ inch. This allows the tool bit holder 64 to be folded into the central channel 44 of the tool handle 32 or 34 as shown in FIG. 1, with space remaining for additional tool blades such as the can opener 62 alongside it.

A tool bit receptacle 256 extends into the body 210 from the outer end 250 and includes an open-ended bit receiving cavity 258 having generally the shape of a narrow hexagonal prism extending longitudinally within the body 210 from the outer end 250 toward the base 130. The bit receiving cavity 258 is made slightly larger than the central driven body 230 of the bits 212, 218, etc., in order to slidingly receive the body portion 230 of each tool bit with interior surfaces of the cavity 258 engaging each of the flat surfaces 238 and 240 and portions of the parallel flat sides 232. This enables the tool bit holder 64 to drive the tool bit 212, etc. and spread the resulting pressures and loads over a sufficiently large area of the interior surfaces of the bit-receiving cavity 258. While the cross section of the bit-receiving cavity 258 could be different, and the shapes of the base or central driven portions 230 of the tool bits could correspondingly be different from those shown herein, the shapes shown herein permit use of the tool bits 212, 218, and 224 in conventional ¼ inch hexagonal drive sockets.

An access opening 260 extends transversely through the body 210 from one to the other of the opposite sides 252, at a location spaced apart from the outer end 250 by a distance 262 of, for example, 0.47 inch. As a result, an end of a tool bit opposite the driving end in use can be seen while the bit is held in the tool bit holder 64. The access opening 260 also permits any dust or other foreign material that has entered into the bit-receiving cavity 258 to be dislodged or to fall free from the body 210. Shallow troughs 263 may be provided extending longitudinally along the side walls of the bit-receiving cavity 258 to accommodate possible distortion of the body 210 during manufacture by metal injection molding methods, and to keep dust from becoming impacted in the bit-receiving cavity alongside the parallel flat sides 232 of a bit held in the bit holder 64. The body 210 has a height 255 that is greater than the thickness 254. The bit-receiving cavity 258 has a width 259 that is less than the thickness 254, and has a depth 261 that is greater than the width 259 but less than the height 255 of the body 210.

A shoulder 264 extends longitudinally along a top of the body 210. A retainer portion 266 defines a slot extending alongside the shoulder 264 and intersecting a generally cylindrical cavity at an end of the slot. A flat retainer spring 268 is provided with a small cylindrical rolled portion at one end. The retainer spring 268 is received within the slot, with the cylindrical rolled end in the cylindrical cavity defined between the retainer 266 and the remainder of the body 210.

An outer end 270 of the spring 268 includes a tip 272 extending through a small channel into the bit-receiving cavity 258. The tip 272 is preferably oriented inward at an oblique angle away from the outer end 250, and the spring 268 is biased elastically into the interior of the bit-receiving cavity, so that when a tool bit such as the bit 218 is slid into the bit-receiving cavity 258 as indicated in FIG. 13, the bit will easily cam the tip 272 out of its own way and permit the bit 218 to be inserted fully into the receptacle 256. The tip 272 will fall into engagement in the notch 248, securely retaining the bit in the receptacle 256 until the spring 268 is lifted, as by cam action of the surfaces of the notch 248 in the bit acting to raise the tip 272 from the notch 248 as the compact tool bit is intentionally withdrawn from the receptacle 256 with sufficient force.

Preferably, a catch 274 is provided on the bottom of the body 210 to be engaged by one's fingernail to open the tool bit holder 64 from a folded position within the central channel 44.

While the spring 268 will retain a tool bit and prevent it from falling out of the tool bit holder 64, it is not intended to withstand pulling forces such as those needed for use of a tool such as a cork puller. A suitable shank or base portion that can be used for any of a variety of small tools such as awls, chisels, or even cork pullers, can be retained more definitely in the tool bit holder 64 by various mechanisms such as those shown in FIGS. 13A–13F.

Figure 13A:
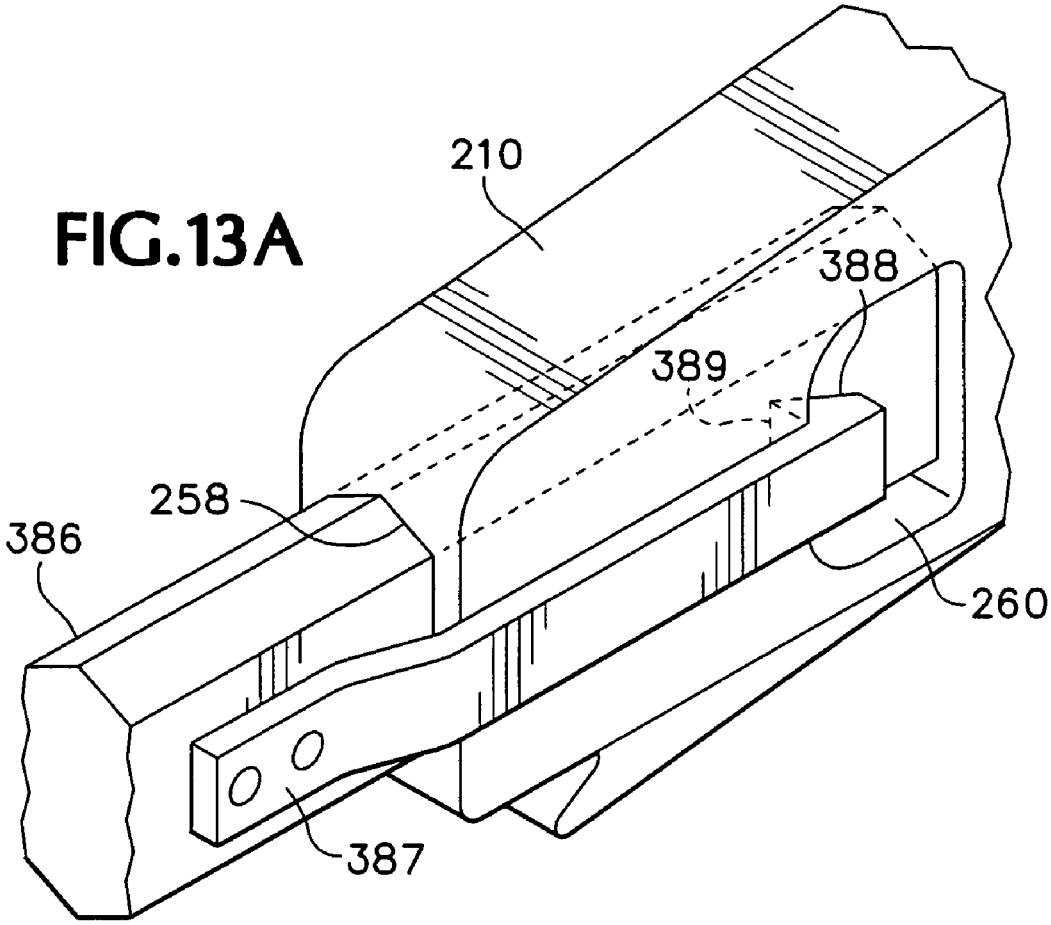
FIG. 13A is an isometric view of portions of a tool bit holder and a tool bit held in the tool bit holder by a retaining hook including a catch.

For example, a tool bit may include a spring-biased hook 387 fastened to its shank at a small distance away from the base portion 386 to be inserted into the tool bit holder 64, as shown in FIG. 13A. Preferably the hook 387 has a beveled surface 388 to assist in urging it away from the base portion to pass along the side 252 of the body 210 of the tool bit holder 64 as the base portion 386 is inserted into the bit receiving cavity 258, and a catch 389 engages the margin of the access opening 260 once the base portion 386 has been pushed far enough into the bit receiving cavity 258. The hook 387 may be attached to the shank by any suitable means, such as by being welded into place.

Figure 13B:
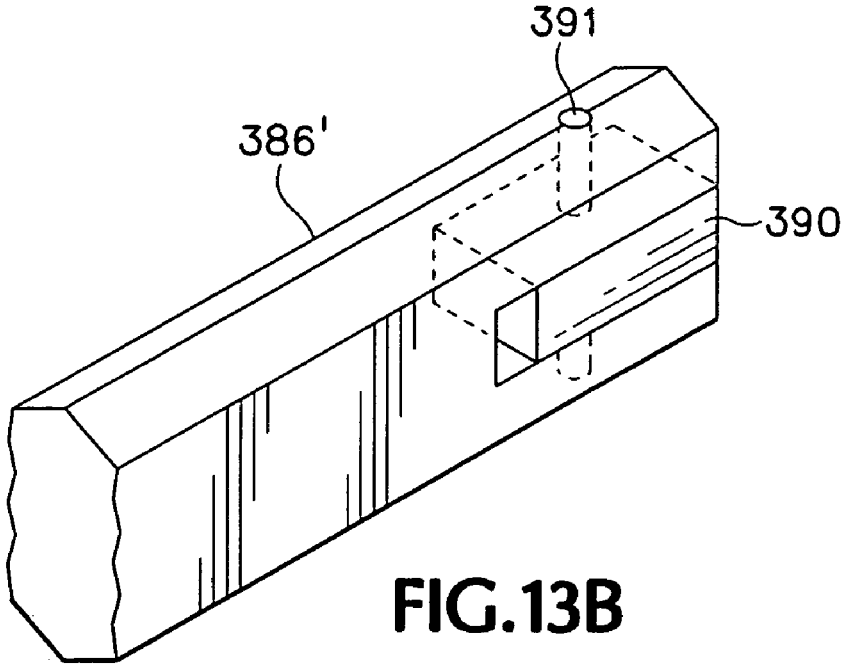
FIG. 13B is an isometric view of a portion of a base portion of a tool bit, including a toggle mounted in the base portion.
Figure 13C:
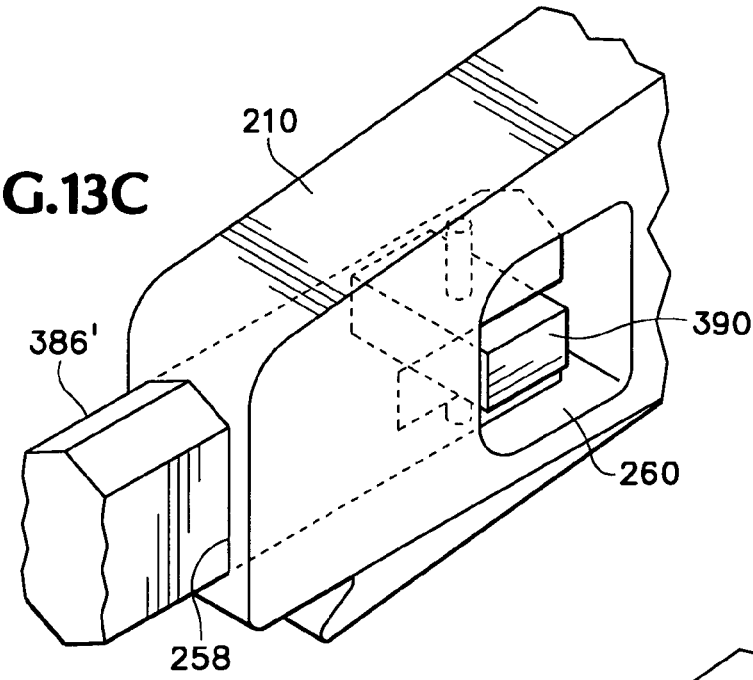
FIG. 13C is an isometric view of the base portion of a tool bit shown in FIG. 13B, with the base portion for a tool bit engaged in a tool bit holder, with the toggle engaged with an access opening in the tool bit holder.

As shown in FIGS. 13B and 13C, a toggle 390 may be mounted on a pivot pin 391 in a base portion 386' in such a way that the toggle in one position leaves the base portion 386' free to slide into the bit receiving cavity 258. The toggle 390 can then be rotated to an interlocking position as shown in FIG. 13B, in which the toggle engages the margins of the access opening 260 to prevent removal.

Figure 13D:
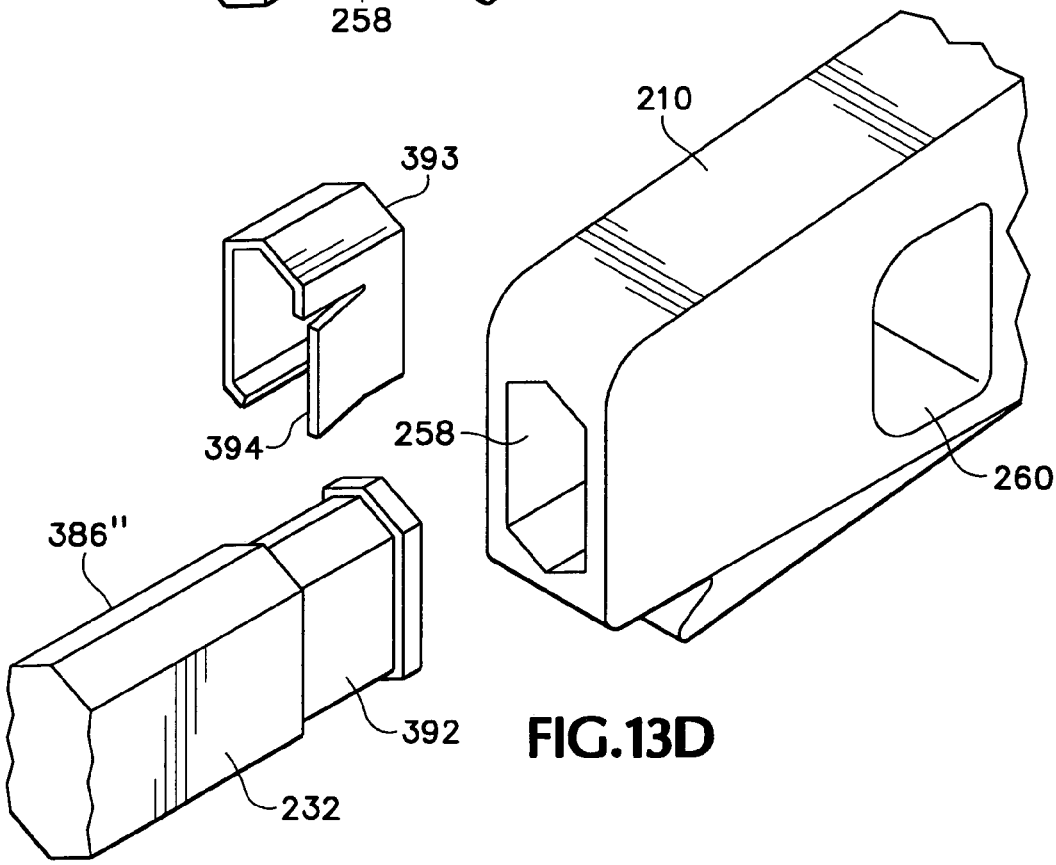
FIG. 13D is an exploded view of a base portion of a tool bit incorporating another latching arrangement for retaining such a tool bit in engagement with a tool bit holder.

As shown in FIG. 13D, a portion of a base portion 386" of a tool bit may be necked down as at 392 to receive a spring clip 393, preferably of metal, formed to fit tightly as a collar around the necked down portion 392 of the tool bit base portion 386". The spring clip 393 includes an outwardly biased resilient portion including a catch 394 directed toward the outer end of the tool bit holder 64. As the base portion 386" is inserted into the bit receiving cavity 258 the catch 394 is forced inward to lie alongside the necked down portion 392, but once the base portion 386" is inserted fully into the bit receiving cavity 258, the catch 394 is free to spring outward beyond the flat side 232 of the base portion 386", so as to engage the interior face of the access opening 260 and retain the bit in the tool bit holder 64. The catch 394 can be pressed inward toward the necked down portion 392 of the base portion 386" far enough to fit within the cavity 258 to allow removal of the base portion 386" from the tool bit holder 64.

Figure 13E:
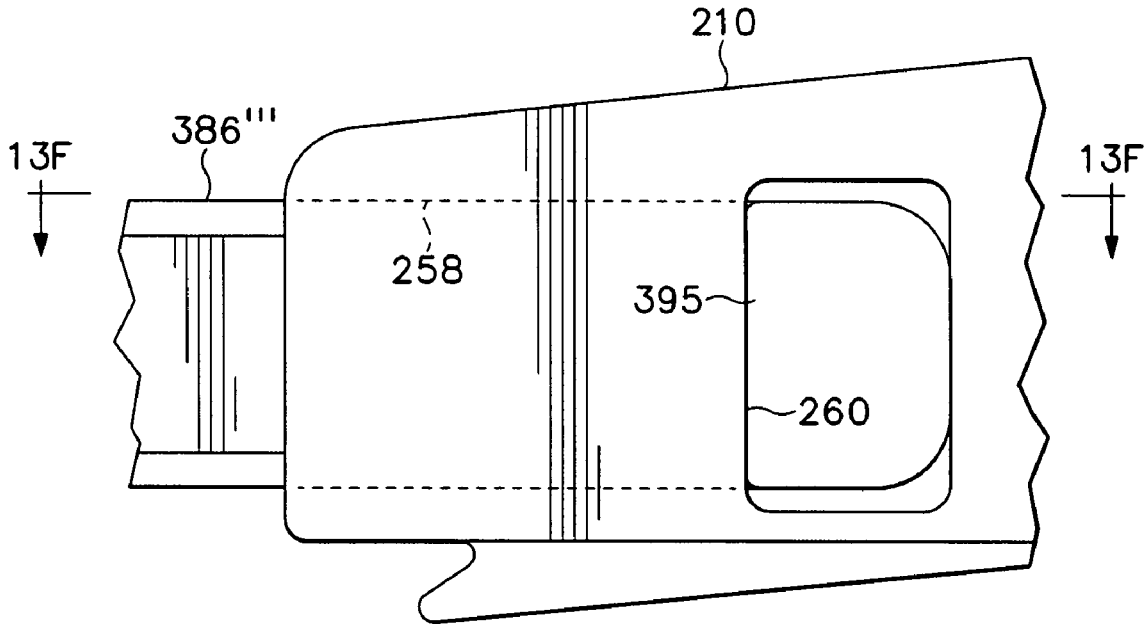
FIG. 13E is a side elevational view of a portion of a tool bit holder and a base portion of a tool bit engaged therein by yet a further retention catch arrangement.
Figure 13F:
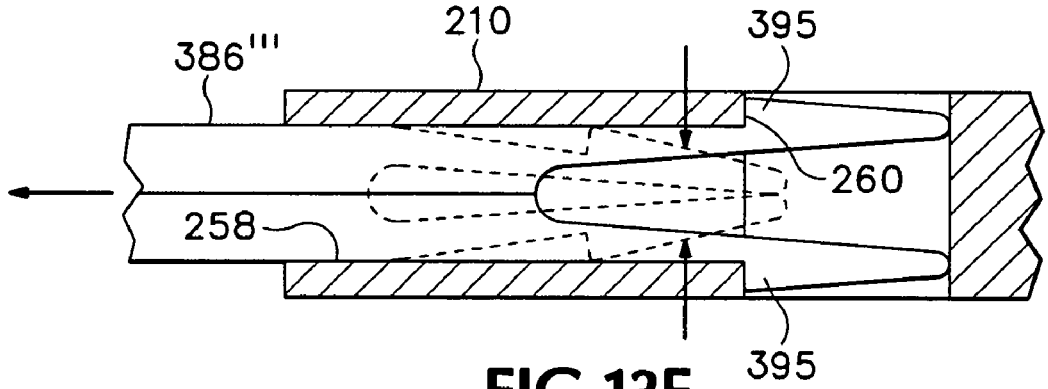
FIG. 13F is a sectional view, taken along line 13F—13F of FIG. 13E.

As shown in FIGS. 13E and 13F, a similar latching ability may be provided by forming the base portion 386'" of a tool bit to include a forked rear end portion. An outwardly protruding barb-like catch 395 on each leg of the fork that extends outward to engage the surfaces of the access opening 260 once the bit has been inserted into the bit receiving cavity 258. The tool bit may be removed from the tool bit holder 64 by pushing on both sides of the fork through the access opening 260 as indicated by the arrows in FIG. 13F, to move the barbs out of their position of engagement with the surface defining the access opening 260, to allow the base portion 386'" to move through the cavity 258, as shown in broken line.

Returning to FIGS. 4 and 9 and also referring to FIG. 9A, the tool bit holder 72 for small tool bits includes a body 280 having a base portion 130' whose shape is similar to the base 130 of the tool bit holder 64 mounted on the pivot pin 68, as may be seen in FIG. 9. The body 280 has a front end 282, and an open-ended tool bit receptacle 284 extends from the front end 282 rearwardly toward the base 130 and is essentially a bore having a hexagonal shape, as shown in FIG. 9A. An access opening 286 extends through the body 280, between its opposite parallel sides 287 intersecting the tool bit receptacle 284.

Projecting into the access opening 286 is a retainer 288 in the form of a small ear that extends into the access opening 286 and partially into space aligned with an imaginary extension of the tool bit receptacle 284 into the access opening 286. A very slender screwdriver bit 74 extends through the tool bit receptacle 284 from the front end 282 toward the base 130 and to an opposite, or inner, end of the access opening 286. The retainer 288 extends into space aligned with the tool bit receptacle 284 and thus interferes slightly with the screwdriver bit 74, requiring it to be elastically bent, or flexed, a small amount such as about 0.005 inch in order for the bit 74 to be inserted fully to the inner end 292 of the access opening 286. The force needed to flex the bit 74 creates sufficient friction to reliably retain the bit 74 in the tool bit holder 72.

A small finger 294 extends from the body 280 to be used to assist in moving the tool bit holder 72 about the pivot pin 68, from its folded position within the channel 44 of the handle 34, to its extended position shown in FIG. 9.

The body 280 has a thickness 296 (FIGS. 3 and 9A) of for example, 0.075 inch, similar to that of the other folding blades for a multipurpose folding hand tool. The tool bit receptacle 284 has a width 298 and a depth 300. The tool bit 74, in a size corresponding with a hexagonal tool bit of a nominal size of 0.0585 inch or slightly less than 1/16 inch (across flats), has a height 302 of, for example, 0.065 inch, and the tool bit receptacle 284 has a corresponding depth 300. The tool bit 74 has a reduced thickness 304 of, for example, 0.049 inch between a pair of opposite faces, and the receptacle 284 has a slightly larger width 298, so that the tool bit 74 can slide within the receptacle 284. Because the height 302 is sufficiently greater than the width 298 of the receptacle 284, the tool bit 74 cannot rotate about its longitudinal axis with respect to the receptacle 284. The thickness 304 is somewhat less than the height 302, so that the tool bit 74 is more slender than it would be with a regular hexagonal cross sectional shape, and so that the tool bit 74 does not require the body 280 to have as great a thickness 296 as it would with a regular hexagonal sectional shape. Nevertheless, as with the tool bits 212 and 218, the tool bit 74 fits in, and can be driven by a conventional socket in the shape of a regular hexagon.

As may be seen most clearly in FIG. 9, the tool bit 74 has a small cruciform driver 306 at one of its opposite ends, and a small straight blade screwdriver bit 308 at its opposite end, shown within the access opening 286. Alternatively, the tool bit 74 could incorporate cruciform or other driver bits of different sizes or various other small tool bits of different sizes at its opposite ends.

Pocket Clips and Lanyard Loops

Figure 8:
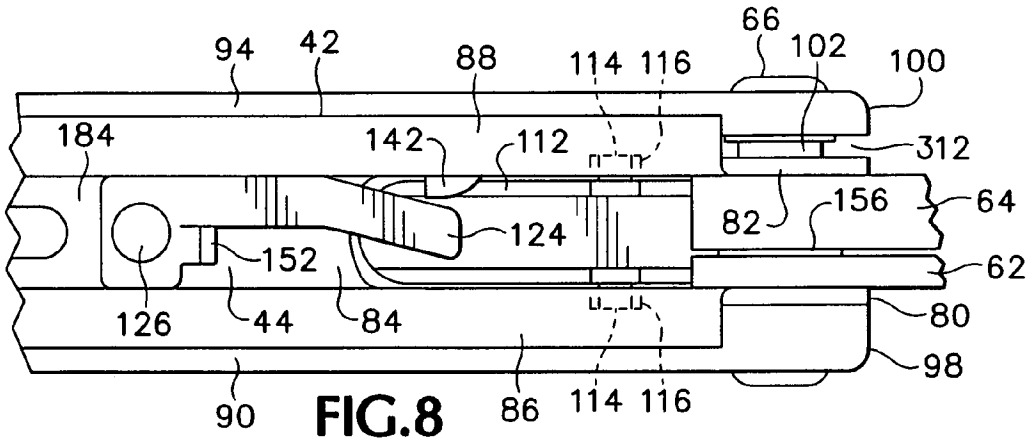
FIG. 8 is an elevational view of a portion of one of the handles of the tool, taken in the direction indicated by the line 8—8 in FIG. 4, with a tool bit holder and another blade shown extended.
Figure 8A:
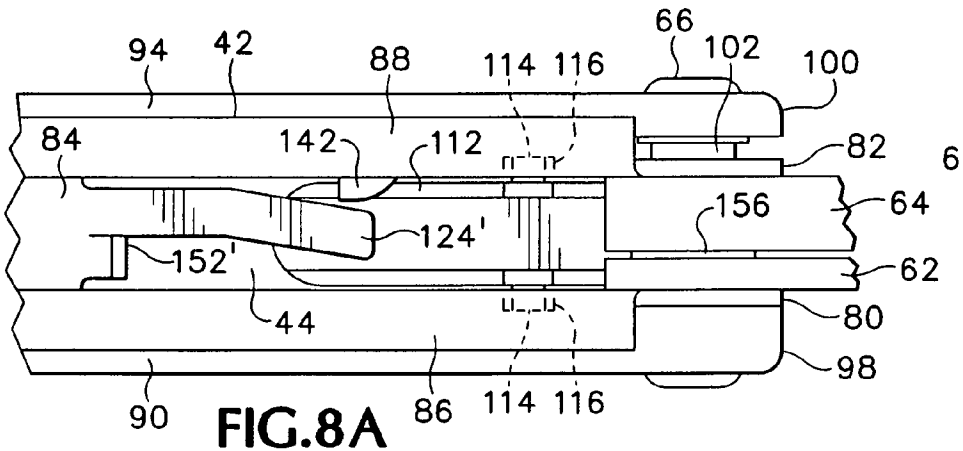
FIG. 8A is a view similar to FIG. 8, but showing a handle incorporating an alternative embodiment of the tool.
Figure 14:
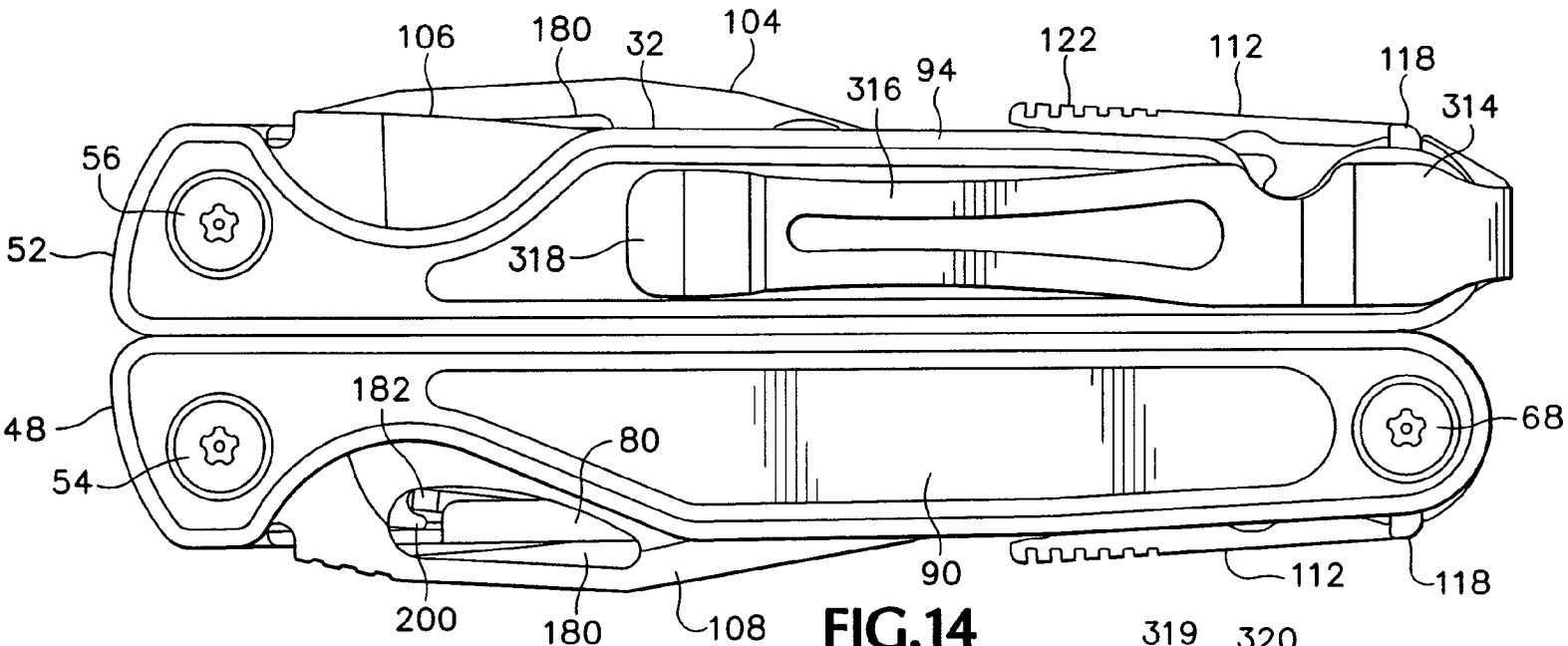
FIG. 14 is a side elevational view of the folded multipurpose tool shown in FIG. 2, taken from the opposite side, and with a removable clip attached thereto.
Figure 16:
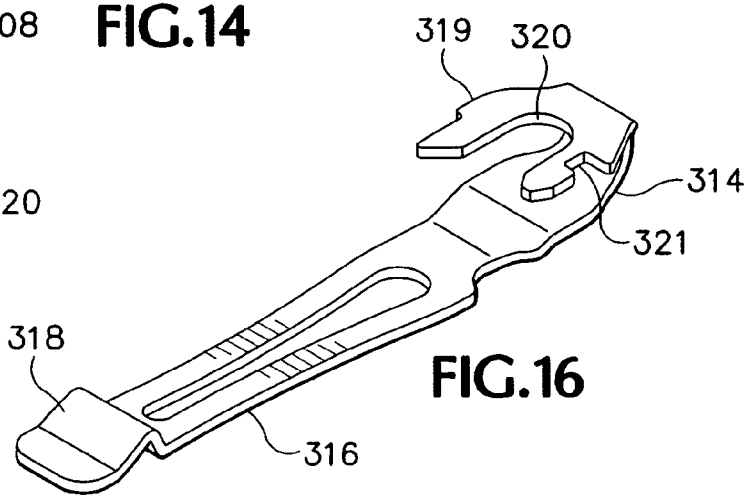
FIGS. 15 and 16 are isometric views taken from opposite sides of the removable clip shown mounted on the folding multipurpose tool in FIG. 14.
Figure 15:
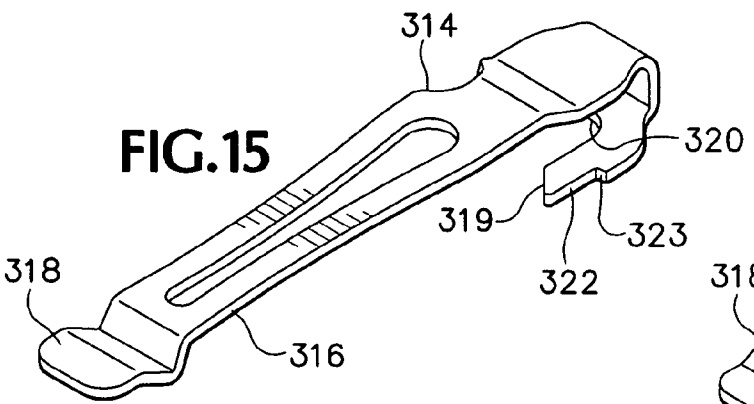

A slot 312 is established by the spacer 102 as an accessory receptacle between the bolster portion 100 and the side wall 82 of the handle 32 as may be seen in FIGS. 3 and 8. As shown in FIGS. 14, 15, and 16, a removable pocket clip 314 is attached to the handle 32. An outer end 316 of the pocket clip 314 extends along the side plate 94 of the handle 32, with its tip 318 biased elastically toward the handle 32 as a result of engagement of a fork portion 319 in the slot 312. The pocket clip 314 is preferably made of suitable sheet metal, cut to shape and bent to a desired form such as that shown.

A throat 320 of the fork 319 preferably fits snugly about the smaller-diameter cylindrical portion of the spacer 102, alongside the radial flange portion of the spacer 102, with a notch 321 engaged releasably by the locking bar 118 carried on the latch lever 112. The spacer 102 provides room between the bolster 100 and the facing side wall 82, and also provides a cylindrical surface to engage the interior of the throat 320, by covering the flats 154 on the pivot pin 66. A guide surface 322 engages a surface of the flange 88 within the outer channel 96, and an abutment surface 323 engages an end surface of the flange 88 to prevent the clip 314 from rotating about the spacer 102.

Figure 17:
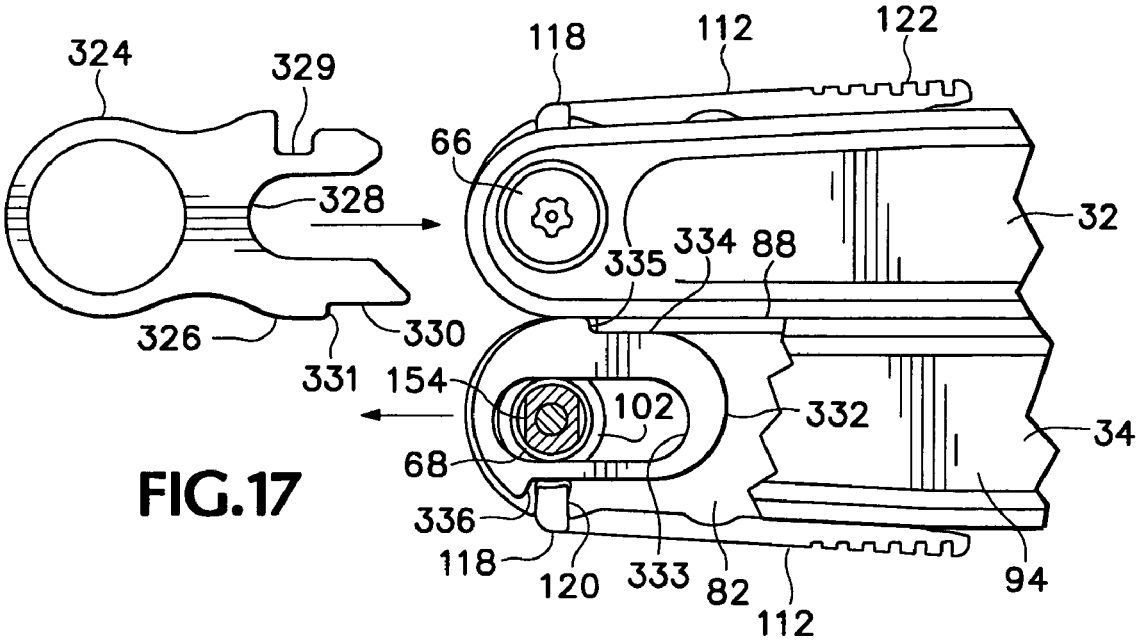
FIG. 17 is a partially cutaway view of the outer, or rear, ends of the handles of the multipurpose tool, taken in the direction indicated by the line 17—17 in FIG. 2, and showing a detachable lanyard loop aligned with one of the handles.
Figure 18:
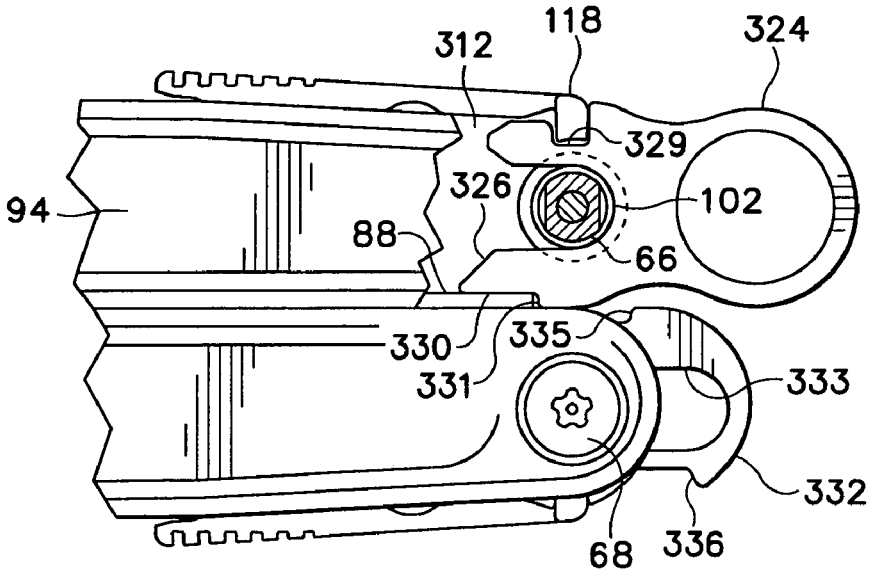
FIG. 18 is a partially cutaway view of the outer, or rear, ends of the handles of the multipurpose tool shown in FIG. 17, but taken in the opposite direction, showing an attached concealable lanyard loop in an extended position and showing the detachable lanyard loop shown in FIG. 17 attached to one of the handles.

In FIG. 17, a detachable lanyard loop 324 is shown in position to be attached to the handle 32 by installing the fork portion 326 of the lanyard loop 324 in the accessory receptacle or slot 312 between the bolster 100 and the side wall 82 at the outer end 58 of the handle 32. As shown in FIG. 18, a throat 328 of the fork 326 preferably fits snugly around the smaller diameter cylindrical portion of the spacer 102, while the radially extending flange portion of the spacer 102 extends alongside the fork portion 326 when the lanyard loop 324 is installed on the handle 32. A notch 329 is engaged by the locking bar 118 carried on the latch lever 112, securely holding the detachable lanyard loop 324 in position, while a guide surface 330 engages a surface of the flange 88 within the outer channel 96, and an abutment surface 331 engages an end surface of the flange 88 to assist in preventing the detachable lanyard loop 324 from pivoting about the spacer 102.

To release the multipurpose hand tool 30 from the detachable lanyard loop 324 for use, as when the multipurpose folding tool 30 is carried on a lanyard attached to the lanyard loop 324, it is only necessary to depress the pressure pad 122 of the latch lever 112 to raise the locking bar 118 from the notch 329. Thus, the tool 30 can be carried on any of several lanyards each equipped with a detachable lanyard loop 324. Other accessories can also be releasably attached to the tool 30 by being inserted into the slot 312 and latched in place by engagement of the locking bar 118.

A retractable tool-retaining lanyard loop 332 provided in the handle 34 is shown in its retracted position in FIG. 17 and in its extended position in FIG. 18. The retractable lanyard loop 332 defines an oval opening 333 fitted around the spacer 102 mounted on the pivot pin 68 of the handle 34 between the bolster portion 100 and the channel side wall 82. A guide surface 334 slides along the adjacent surface of the flange 88 of the handle main frame member 42 of the handle 34 as the retractable lanyard loop 332 is moved between its fully extended base portion position and its retracted position. An abutment face 335 engages the end of the flange 88 when the retractable lanyard loop is fully retracted into the slot 297. A nick 336 may be engaged to push the retractable lanyard loop 332 from its retracted position.

The retractable lanyard loop 332 may be made of sheet metal cut to a shape such as that shown best in FIG. 17 and then bent out of the original plane of the sheet metal to a shape such as that shown in FIG. 3, for example. Thus the lanyard loop is a portion of a large radius cylinder, so that respective portions of the loop press against the bolster portion 100 and the channel side wall 88, creating ample friction to keep the lanyard loop 332 in its retracted position and prevent it from rattling.

Alternative Embodiments of the Tool

Figure 19:
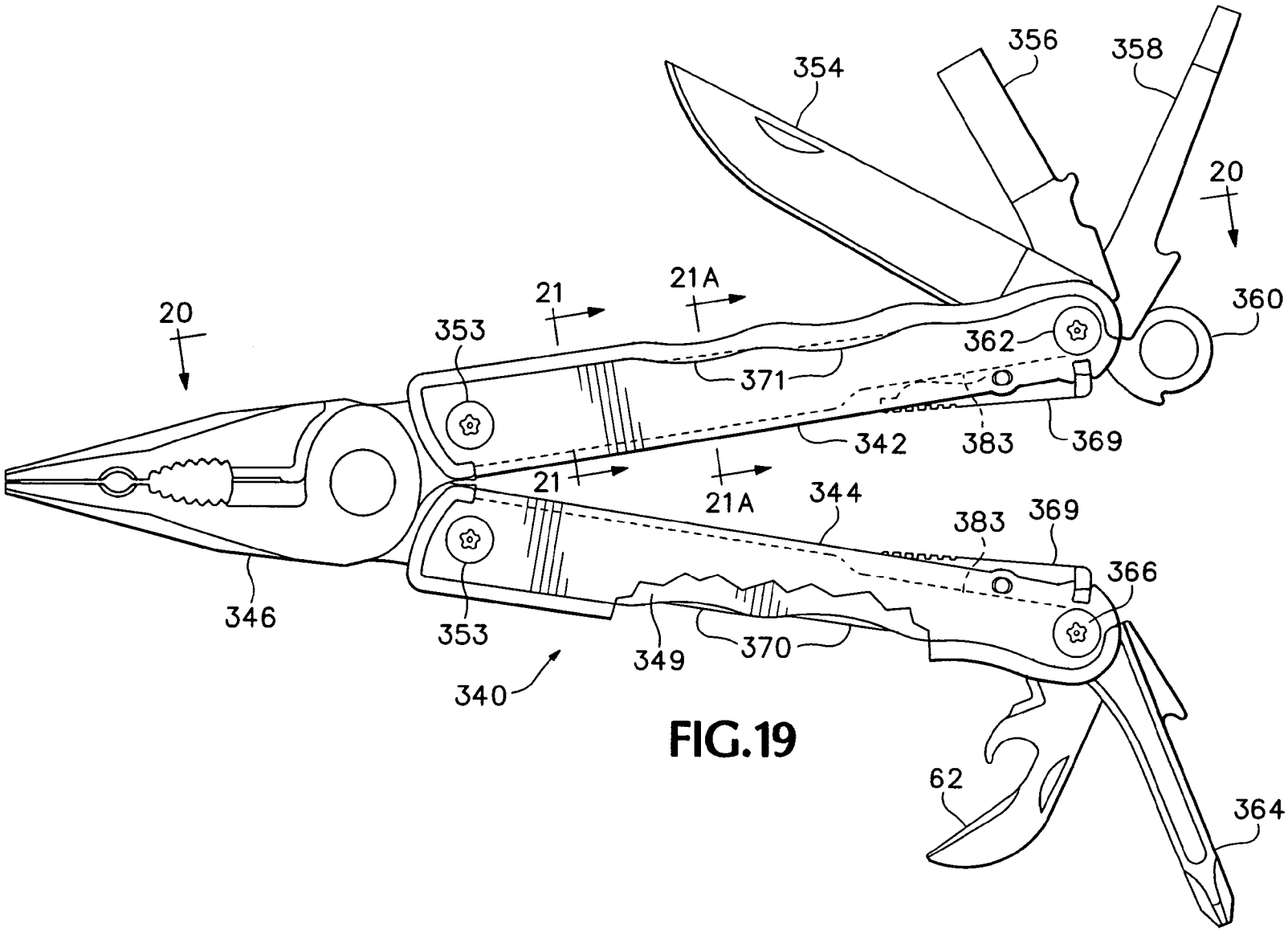
FIG. 19 is a partially cutaway side elevational view of a multipurpose tool which is an alternative embodiment of the present invention, taken in a direction similar to that of FIG. 4.

A folding multipurpose tool 340 shown in FIGS. 19, 20, 21, and 21A is of somewhat simpler construction than that of the multipurpose tool 30, and includes a pair of handles 342 and 344, each having a front end attached to a base of a respective one of the jaws of a pair of pliers 346 by a respective pivot pin 353. The handles 342, 344 are of similar, but mirror-opposite construction, each including a U-shaped channel portion 347 having a bottom 348 and a pair of opposite, parallel side walls 349 preferably formed of suitable sheet metal, such as stainless steel. Along an inner side of and mated with each side wall 349 of the channel portion 347 is an insert 350 or 351 that interlocks with a margin 352 of the respective side wall 349. Each insert 350 extends around and along the margin 352 so as to provide greater thickness and greater comfort for a hand squeezing on the handles 342, 344 with the handles 342 and 344 extended with respect to the pliers 346 as shown in FIG. 19. The inserts 350 may be made of an appropriate plastics material, which may be rubberlike, or the inserts 350 may be of different materials including metal, in order to achieve different appearances and provide a different feel. In one preferred embodiment, at least outer margins of the inserts 350 are of elastomeric material providing a non-slip gripping surface.

Figure 20:
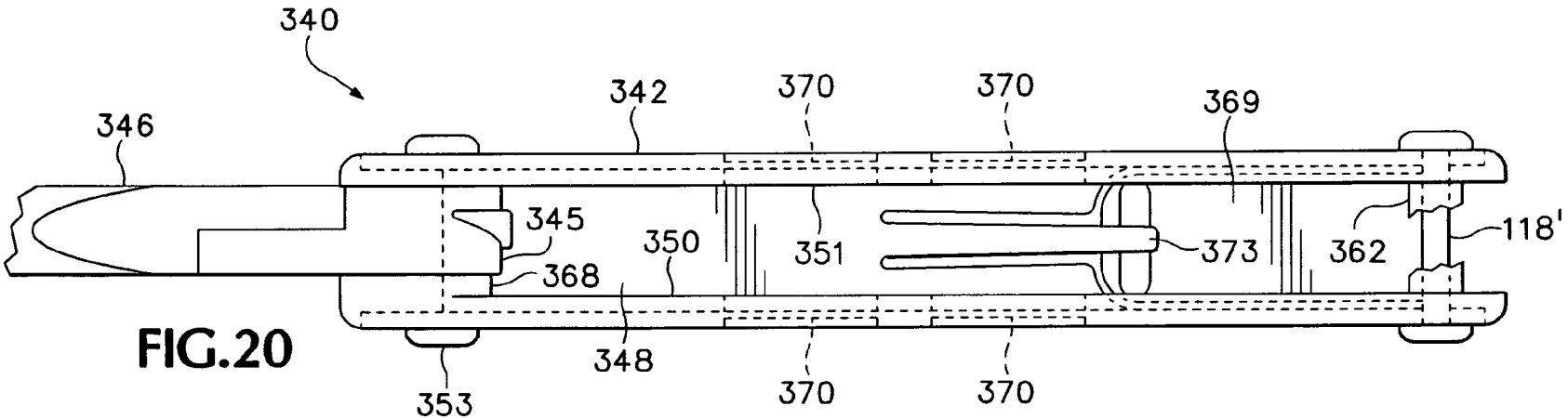
FIG. 20 is a view of the handle of the tool shown in FIG. 19, taken in the direction indicated by the line 20—20 of FIG. 19.

Various tool blades are provided at the rear or outer end of each of the handles 342 and 344, opposite the attachment of the pliers jaws. For example, a knife blade 354, a straight screwdriver blade 356, a smaller straight screwdriver blade 358 and a lanyard loop 360 are mounted on the handle 342, and all are pivotable about a pivot pin 362 between respective extended and folded positions. Attached similarly to the handle 344 as shown in FIG. 19 are a can opener 62 and a Phillips screwdriver 364, both mounted on a pivot pin 366. As shown in FIG. 20, the handle 342 is wider than the base 345 of the pliers 346, and the insert 350 accordingly includes a spacer portion 368 to keep the pliers jaw base 345 properly located with respect to the width of the handles.

Figure 21A:
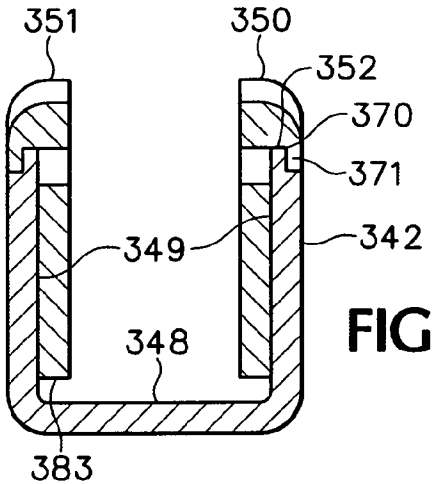
FIG. 21A is a sectional view of one of the handles shown in FIG. 19, taken along line 21A—21A of FIG. 19.
Figure 21:
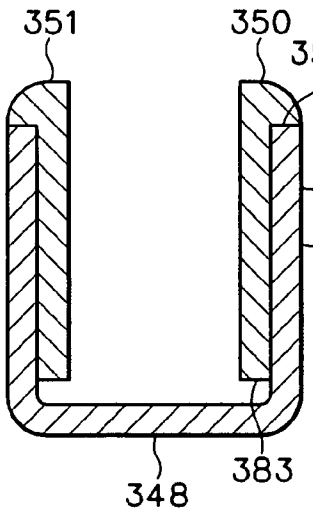
FIG. 21 is a sectional view of one of the handles shown in FIG. 19, taken along line 21—21 of FIG. 19.

The margins 352 of the side walls 349 are shaped to a reduced thickness at one or more places, as by coining, for example, as shown at 370 in FIGS. 19 and 21A. Corresponding portions 371 of the inserts 350 extend around those portions of the side walls 349 and support the inserts 350, particularly along the margins 352, so that the inserts 350 are not free to be forced into the middle of the handles 342 and 344 as a result of one's grip on the handles during use of the tool. End portions of the inserts 350 are supported and held against the side walls 349 by the presence of the base 345 of the respective jaw at the front end, and by the accumulated thicknesses of the bases of the folding tools such as the knife 354, screwdriver 356, screwdriver 358, and spacers placed between those blades, at the rear or outer end of each handle 342 and 344.

A blade latch and release mechanism is provided in the folding multipurpose tool 340 in a form similar to that of the latch and release mechanism in the folding multipurpose tool 30 described above. A latch lever 369 is similar to the latch lever 112, except for having a greater width to fill the space between the side walls 349 of the handle 342 or 344, which are separated further than the side walls 80 and 82 of the handles 32 and 34 of the tool 30. The latch lever 369 includes trunnions 114', which are engaged in elongated holes 116' in the side walls 349 in the same fashion as that in which the trunnions 114 are engaged in the elongated holes 116 in the folding multipurpose tool 30 as described above. A locking bar 118', similar to the locking bar 118, is carried on an outer end of the latch lever 369. The side walls 349 of each handle 342 and 344 define respective latch support notches 120' similar to the latch support notches 120 in the handles of the folding multipurpose tool 30. The locking bar 118' thus cooperates with the latch support notches 120' in the same fashion described above with respect to the locking bar 118 and the latch support notches 120.

Preferably, the various tool blades 354, 356, 358, etc. are the same as, or interchangeable with, the blade 62 or tool bit holders 70 and 72, or similarly located blades, and their base portions 376 are preferably substantially the same as the base portions 130 and 130' with which the locking bar 118 cooperates as described previously. The bottom 348 of the channel part 347 is shaped to define a finger-like spring 373 that acts on the inner end of the lever 369, urging it to rotate about the trunnions 114' to move the locking bar 118' into engagement in the latch support notches 120' and also into the engagement notch 134 of any of the various tool blades that is extended. Movement of the latch lever 369 about the pivot axis defined by the trunnions 114' is limited at the appropriate position by the margins 383 of the inserts 350, as may be seen in FIGS. 19 and 20, to prevent the locking bar 118' from moving out of the latch support notches 120' in the side walls 349 beyond a position in which it is supported by the sides of the latch support notches, and to prevent it from bending the spring 373 beyond its elastic limit.

Figure 22:
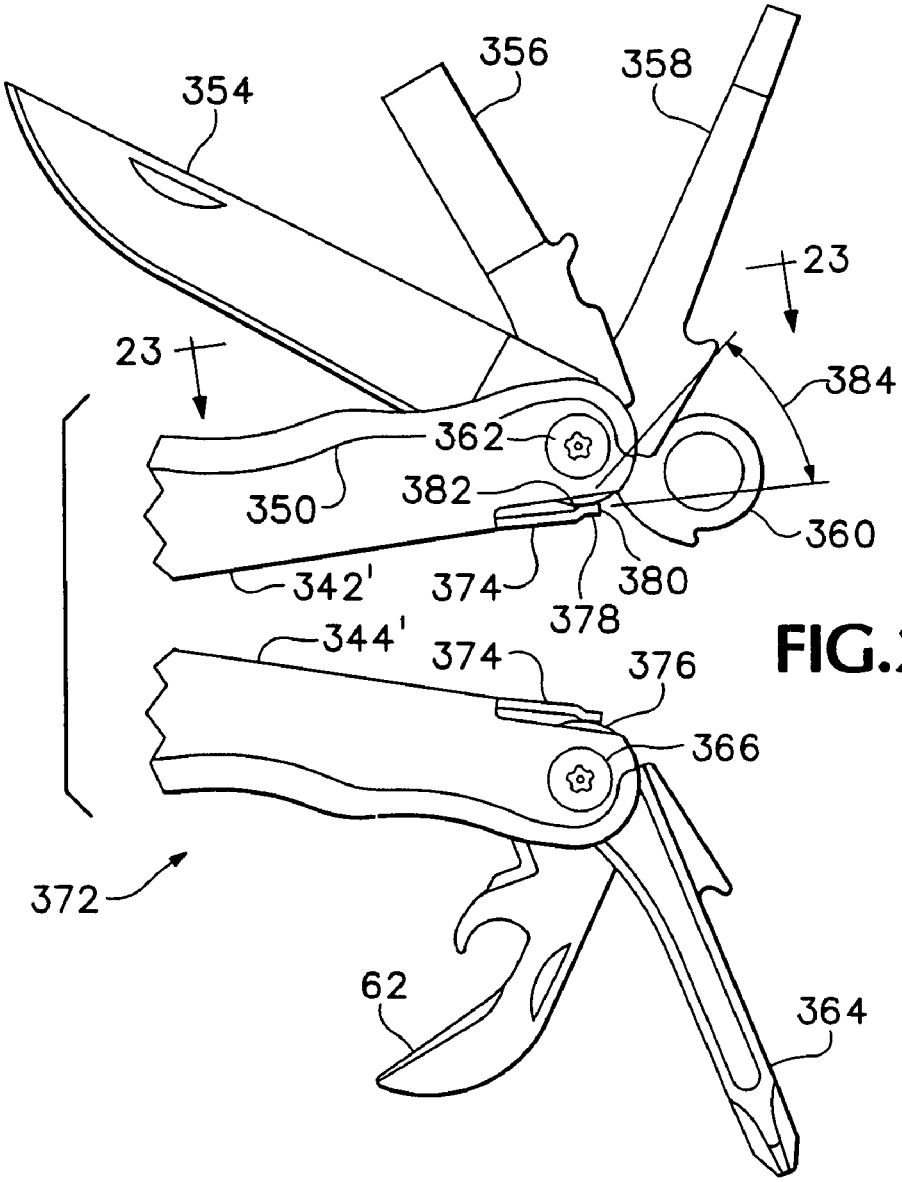
FIG. 22 is a side elevational view of the outer end portions of a pair of handles of an alternative construction, for a tool similar to that shown in FIGS. 19, 20, and 21.
Figure 23:
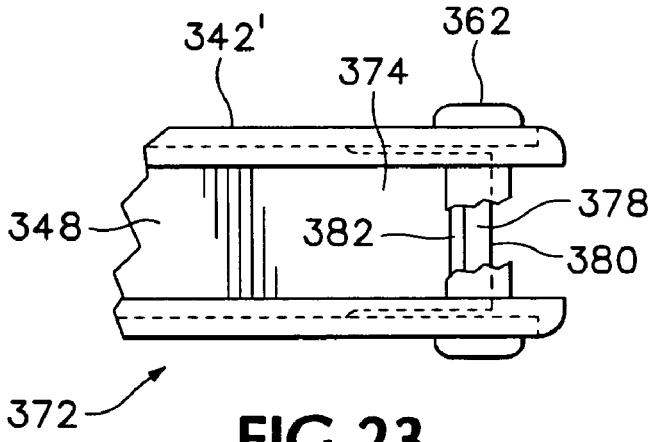
FIG. 23 is a view of one of the portions of handles for a tool shown in FIG. 22, taken in the direction of line 23—23 in FIG. 22.
Figure 24:
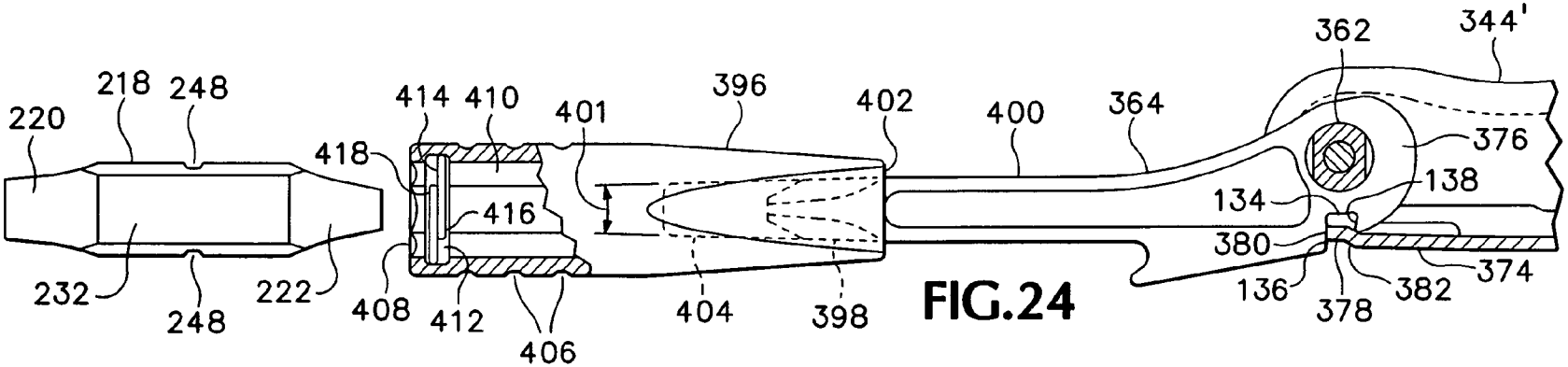
FIG. 24 is a partially cutaway view of a portion of a handle such as one of the handles of the tool shown in FIGS. 22 and 23, together with a folding screwdriver mounted on the end of the handle and a tool bit drive adaptor coupled with the end of the screwdriver, and showing a spring detent holding the screwdriver in its extended position.

As shown in FIGS. 22 and 23, a folding multipurpose tool 372 is a somewhat more simplified version of the tool 340 and has a spring detent system for holding and supporting tool blades at the outer ends of its handles 342' and 344', rather than the latch mechanism described previously with respect to the folding multipurpose tool 30 and 340. The various tool blades 354', 356', 358', etc., are the same as, or interchangeable with, those of the tool 340, previously described. Each of the handles 342' and 344' includes a spring 374 at its second, or outer, end, biased elastically into contact with a base portion 376 of each of the several tool blades. A tip of the spring 374 has an offset portion 378, which cooperates with the notches 134 in the base portions 376 of the several blades 354', 356', etc.

The offset portion 378 of the spring 374 engages the respective notch 134 when one of the several blades is rotated to its extended position. The offset portion 378 is interconnected with the remainder, or inner part of the spring 374 in each of the handles 342', 344', by a transition part 382 oriented at a slope or angle 384 of, for example, about 30°. The transition part 382 enters the notch 134 adjacent the edge of the rear wall 138 and acts as a detent, while an end face 380 of the offset portion 378 engages the abutment wall 136 of the notch 134. Because of the slope of the transition part 382, the offset portion 378 can be removed from the notch 134 by application of a moderate amount of force to move the respective blade about its pivot pin 362 or 366 in the direction of its folded position, and the rear wall 138 lifts the offset portion 378 free of the notch 134 by cam action on the transition part 382.

Tubular Bit Driver

Referring next to FIGS. 22, 23, 24, and 25, the Phillips screwdriver 364 shown in FIG. 19 may be used to drive a tubular bit driver 396 that is preferably made of the same material as the screwdriver 364, and which fits removably on a tapered driving end 398 of the Phillips screwdriver 364. The Phillips screwdriver includes a shank or driving shaft portion 400, which is generally square in cross-sectional shape, although a portion of it may be in a square I-beam cross-sectional shape to reduce weight. The driving end 398 is tapered slightly, at an angle 401 of convergence of, for example, about 3° between the opposite sides of each of the two pairs of sides of the driving end 398. The bit driver 396 has an inner end 402 defining a drive socket 404 extending longitudinally into the bit driver 396. The interior of the drive socket 404 similarly is of square cross section and tapered at the same angle, so that the opposite sides of the drive socket 404 also converge toward each other at a small angle of, for example, about 3°.

As a result of the taper, when the driving end 398 is inserted into the drive socket 404, the bit driver 396 fits snugly, and is mated therewith with sufficient friction so that the bit driver 396 sticks in place on the driving end 398 of the Phillips screwdriver 364, from which it will not unintentionally fall free simply because the tool is handled as in the course of normal use. At the same time, however, the bit driver 396 can easily be separated from the driving end 398 merely by pulling them apart.

Preferably, grooves 406 may be provided about the outer surface of the outer end 408 of the bit driver 396, to aid in gripping it.

Figure 26:
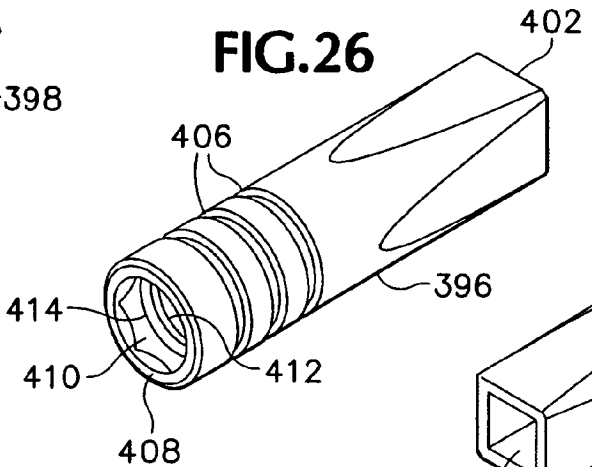
FIG. 26 is an isometric view of the tool bit drive adaptor shown in FIG. 22, taken from a first end.
Figure 27:
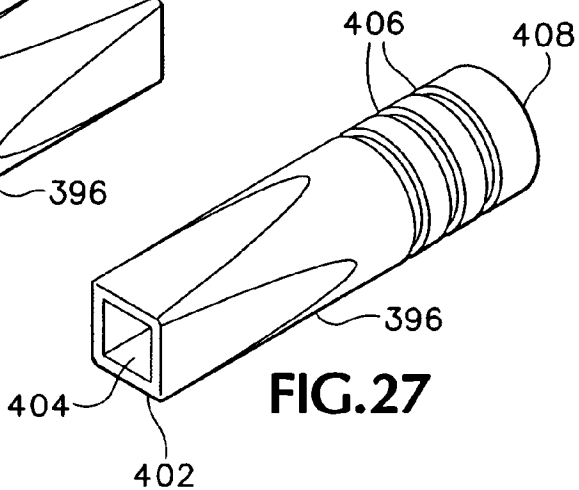
FIG. 27 is an isometric view of the tool bit drive adaptor shown in FIGS. 22 and 24, taken from the end opposite that shown in FIG. 26.
Figure 25:
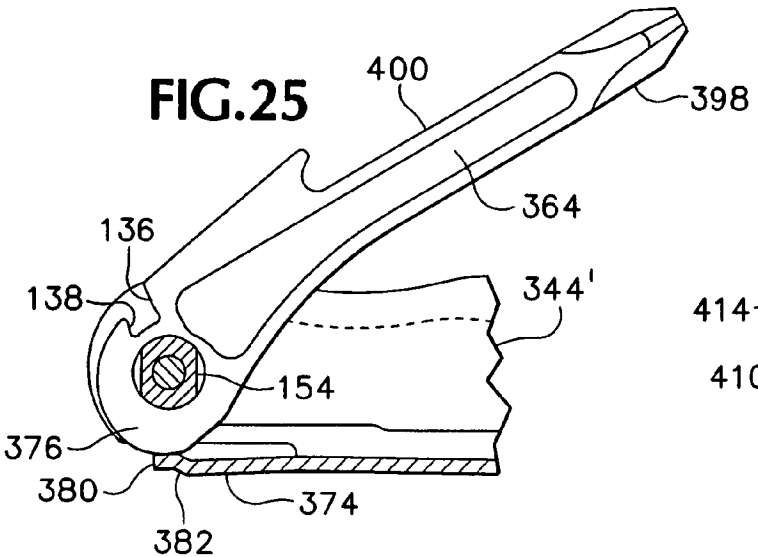
FIG. 25 is a view in the same direction as FIG. 24, showing the screwdriver and portion of a handle with the screwdriver in an intermediate position between its folded position and the extended position shown in FIG. 24.

The outer end 408 defines a bit-receiving socket 410 such as a ¼ inch hexagonal socket capable of receiving and driving conventional tool bits and the compact reduced thickness tool bits 212, 218, and 224 mentioned above. The socket 410 preferably includes an internally located circumferential groove 412 shown in FIGS. 24 and 26. Captured within the groove 412 is a circular tool retention spring 414 of wire or other slender form with two overlapping ends 416 and 418 free to move with respect to each other to allow the spring to expand in diameter to receive a tool such as a compact screwdriver bit 218. When relaxed, the spring remains engaged in the groove, but the slender material of the spring has a great enough thickness to engage the retention notch in a tool bit in the conventional fashion. The ends 416 and 418, moreover, overlap each other far enough, for example, by about 30° of the circumference of the spring 414 or the groove 412, so that when the spring is expanded by insertion of a tool bit into the socket, the ends 416 and 418 continue to overlap each other. As a result, there is no empty gap between the ends of the circle of spring material, and a compact tool bit 212 or 218 will be engaged and securely held in the socket 410 by a portion of the spring engaged in the notch 248 in each of the opposite margins 234 and 236 of the compact tool bit.

Alternative Tool Bit Holder

Figure 28:
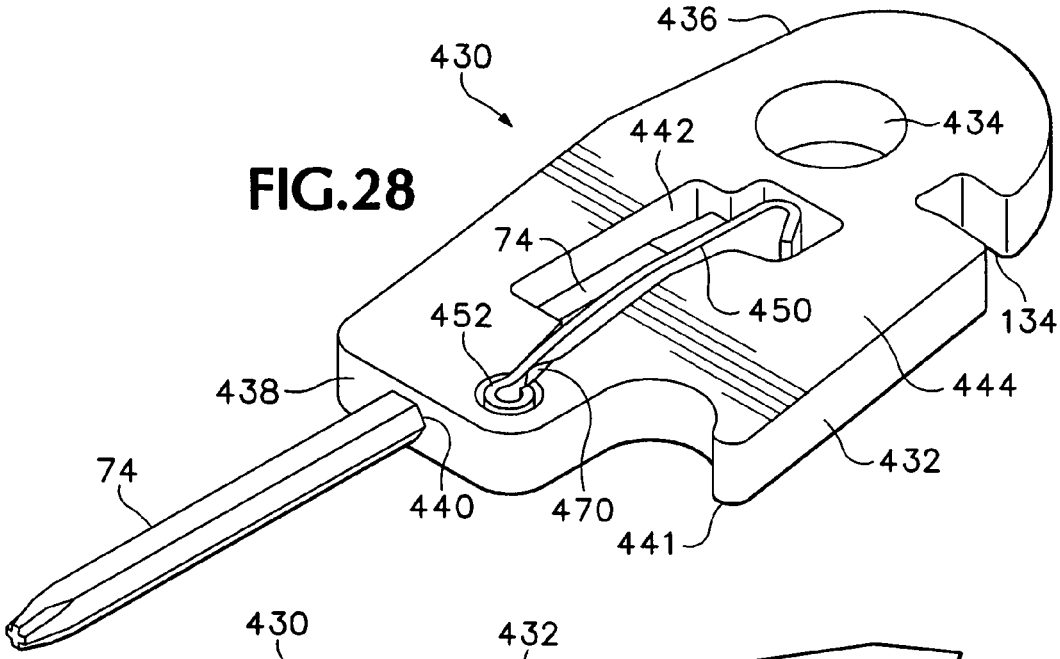
FIG. 28 is an isometric view of a tool bit holder that is an alternative embodiment of one aspect of the invention.
Figure 29:
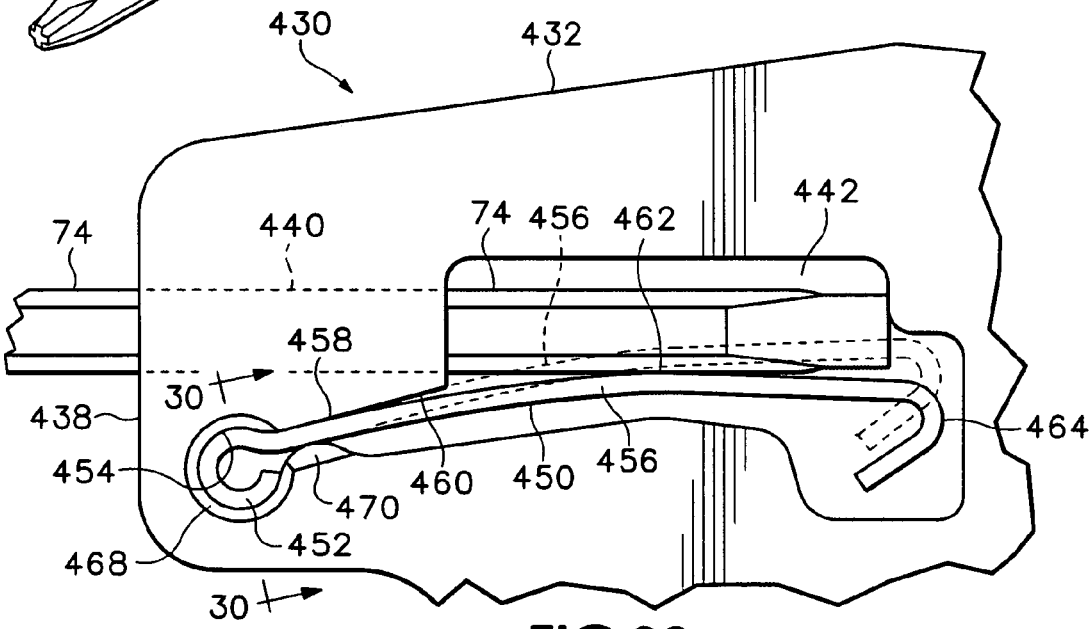
FIG. 29 is a side elevational view of a portion of the bit holder shown in FIG. 28, at an enlarged scale, together with a slender tool bit.
Figure 30:
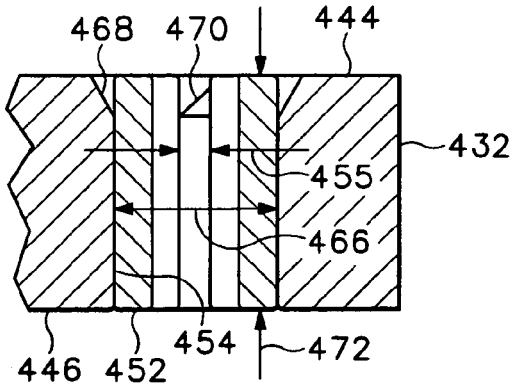
FIG. 30 is a sectional view of a detail of the tool bit holder shown in FIGS. 28 and 29, taken along line 30—30 of FIG. 29.

Referring now to FIGS. 28, 29 and 30, a tool bit holder 430 may be used instead of the tool bit holder 72 to hold a tool bit such as a slender tool bit 74. The tool bit holder 430 includes a body 432 which may be easily manufactured by metal injection molding or other metal machining methods, in the general form of a flat, parallel-sided plate, in order to fit within and be foldable or extendable with respect to a tool handle, such as one of the handles of the folding multipurpose hand tool 30. The body 432 includes a pivot pin hole 434 to accommodate a pivot pin such as the pivot pin 68 shown in FIG. 9. As in the tool bit holder 72, the body 432 of the tool bit holder 430 preferably includes a base portion 436 whose shape is similar to the base portion 130' of the tool bit holder 72. The base portion 436 also preferably includes a latch engagement notch 134 as in the base 130' of the tool bit holder 72, to be able to cooperate with the blade latch and release mechanism described previously.

The body 432 has a front end 438, and an open-ended tool bit receptacle 440, similar to the tool bit receptacle 284 in the tool bit holder 72, extends from the front end 438 rearwardly toward the base portion 436. The receptacle 440 is essentially a bit-receiving cavity or bore, like the tool bit receptacle 284, as shown in FIG. 9A. An indentation defines a small finger 441 extending from the body 432 to be used in moving the tool bit holder 430 about the pivot pin 68 from its folded position within the channel 44 of the handle 34, to its extended position similar to that of the tool bit holder 72 shown in FIG. 9. An access opening 442 is defined in the body 432 and extends through the body 432, between its opposite parallel sides 444 and 446.

The tool bit receptacle 440 is preferably large enough to receive a tool bit such as the slender driver 74 slidingly, yet without being excessively loose, and is of a hexagonal or other shape corresponding to the shape of the tool bit intended to be driven by the tool bit holder 430. Thus, while the tool bit receptacle 440 is shown as being hexagonal, it could be of a different shape to accommodate and mate drivingly with a tool bit of a different shape.

A retainer spring 450 is mounted in the body 432 in such a way that a portion of the spring 450 presses against a tool bit such as the slender screwdriver bit 74 when such a bit is in place in the tool bit receptacle 440, as shown best in FIG. 29.

In one preferred embodiment, the retainer spring 450 may be a flat spring and may be essentially identical with the spring 268 incorporated in the tool bit holder 64 described above. As shown, the retainer spring 450 is of flat, ribbon-like metal and includes a cylindrical rolled portion 452 at one end, which is held in a cylindrical spring seat 454 defined in the body 432. An intermediate part 456 of the retainer spring 450 extends from the cylindrical rolled portion 452 through a slot 458 that communicates between the spring seat 454 and the access opening 442. A surface 460 defining a first side of the slot 458 permits the intermediate part 456 of the spring 450 to extend into the portion of the access opening 442 that is occupied by the tool bit 74, when the tool bit 74 has been removed from the tool bit holder 430, as shown in broken line in FIG. 29. That is, the retainer spring 450 extends, within the access opening 442, into a space aligned with an imaginary extension of the tool bit receptacle 440. A shallow bend 462 may be formed in the intermediate part 456 and forms a shoulder that ordinarily bears on a surface of a tool bit such as the screwdriver bit 74 when such a bit is held in the tool bit holder 430, with the result that the retainer spring 450 is thereby flexed to the position shown in FIG. 29 in solid line. A second, free, end 464 of the retainer spring 450 can rest on an interior surface of the access opening 442 when the screwdriver bit 74 or similar tool is not present in the tool bit holder.

Preferably, the cylindrical rolled portion 452 of the retainer spring, when relaxed, has a diameter slightly larger than the diameter 466 of the spring seat 454, while one end of the spring seat 454 is chamfered, as shown at 468, and a sloped face 470 is provided on one side of the slot 458, to compress the cylindrical rolled first end portion 452 and guide the retainer spring 450 as the retainer spring 450 is forced into position in the body 432. Thus, the cylindrical rolled end portion 452 can be compressed to reduce the space indicated by the arrow 455. Thereafter, the elastic force of the cylindrical rolled portion 452 against the inside of the spring seat 454 generates friction that holds the retainer spring 450 securely. Pressure of the shoulder defined by the bend 462 against the surface of a tool bit such as the slender screwdriver 74 results in friction against the tool bit that securely holds such a tool bit in the tool bit receptacle 440 in spite of any shock ordinarily expected to be encountered, preventing loss of such a tool bit from the tool bit holder 430.

As shown in FIGS. 28, 29, and 30, the retainer spring 450 has a width 472 equal to the thickness of the body 432 between its opposite sides 444 and 446, but a retainer spring 450 narrower than the thickness of the body 432 would also be useful, and the same retainer spring 450 might be used in different tool bit holders 430 of somewhat different sizes, so long as the retainer spring 450 is held securely enough in the spring seat 454 to ensure that the intermediate part 456, or shoulder, of the retainer spring 450 consistently comes to bear against a tool bit held in the tool bit receptacle 440.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

We claim:

1. A bit holder for use with a hand tool, comprising:

(a) a generally plate-like body, said body having a first end adapted to be connected drivably to a handle, a second end opposite said first end, a length between said first and second ends, and a thickness between a pair of opposite sides extending from said second end toward said first end;

(b) a tool bit receptacle located at said second end, said receptacle including a bit-receiving cavity extending into said body from said second end, said bit-receiving cavity being shaped to drivingly engage a portion of a selected tool bit, and said body defining an access opening extending transversely therethrough from one of said pair of opposite sides to the other and intersecting with said bit-receiving cavity at a predetermined distance from said second end; and (c) a retainer spring having a first end attached to a spring seat in said body, said retainer spring extending into said access opening from said spring seat and extending generally longitudinally with respect to said body within said access opening, with a width of said retainer spring extending parallel with said thickness of said body and said retainer spring being elastically biased toward a location that is within said access opening and aligned with said bit-receiving cavity.

2. A subassembly for a hand tool, comprising:

(a) a handle defining a tool stowage cavity;

(b) a tool bit holder attached to said handle and movable with respect to said handle between a first position substantially within said tool stowage cavity and a second position extending from said handle, said tool bit holder including:

(i) a generally plate-like body, said body having a first end connected drivably to said handle, a second end opposite said first end, a length between said first and second ends, and a thickness between a pair of opposite sides extending from said second end toward said first end;

(ii) a tool bit receptacle located at said second end, said receptacle including a bit-receiving cavity extending into said body from said second end, said bit-receiving cavity being shaped to drivingly engage a portion of a selected tool bit, and said body defining an access opening extending transversely therethrough from one of said pair of opposite sides to the other and intersecting with said bit-receiving cavity at a predetermined distance from said second end; and (iii) a retainer spring having a first end attached to said body, said retainer spring extending from said first end longitudinally along said length of said body and generally perpendicular to said thickness of said body into said access opening, and said retainer spring being elastically biased toward a location that is within said access opening and aligned with said bit-receiving cavity.

3. A bit holder for use with a hand tool, comprising:

(a) a generally flat body, said body having a first end adapted to be connected pivotably and drivably to a handle, a second end opposite said first end, a length between said ends, and a thickness between a pair of opposite sides extending from said second end toward said first end;

(b) a tool bit receptacle located at said second end, said receptacle including a bit-receiving cavity extending longitudinally into said body from said second end, said bit-receiving cavity being shaped to drivingly engage a portion of a selected tool bit, and said body defining an access opening extending transversely through said body from one of said pair of opposite sides to the other and intersecting with said bit-receiving cavity at a predetermined distance from said second end; and (c) wherein a retainer spring is attached to said body and projects generally longitudinally along said length of said body and generally perpendicular to said thickness of said body into said access opening and into a space within said access opening defined by an imaginary extension of said bit-receiving cavity into said access opening, and wherein said retainer spring thus is in such a location that a bit extending through said bit-receiving cavity into said access opening is engaged elastically by said retainer spring while extending through said bit-receiving cavity.

4. The bit holder of claim 3 wherein said retainer spring has a first end mated with said body.

5. The bit holder of claim 4 wherein said retainer spring is a flat spring and said first end thereof includes a cylindrical rolled portion.

6. The bit holder of claim 4 wherein said retainer spring has a second end and has an intermediate portion defining a shoulder projecting into contact against said bit and thereby causing sufficient friction between said bit and said bit-receiving cavity to retain said bit.

7. The bit holder of claim 4 wherein said body defines a spring seat and said first end of said retainer spring is resiliently compressed to fit within said spring seat.

8. A bit holder for use with a hand tool, comprising:

(a) a body, said body having a first end adapted to be connected pivotally and drivably to a handle, a second end opposite said first end, and a pair of opposite sides extending from said second end toward said first end;

(b) a tool bit receptacle located at said second end, said receptacle including a bit-receiving cavity extending into said body from said second end, and said bit-receiving cavity being shaped to drivingly engage a portion of a selected tool bit, and said body defining an access opening that extends transversely into said body from one of said pair of opposite sides toward the other and intersects with said bit-receiving cavity at a predetermined distance from said second end; and (c) a retainer spring attached to said body and extending longitudinally into said access opening, said retainer spring being elastically biased toward a location within said access opening that is aligned with said bit-receiving cavity, and said spring being accessible by a user through said access opening to release said tool bit from engagement by said retainer spring.

9. A bit holder-for use with a hand tool, comprising:

(a) a body, said body having a first end adapted to be connected pivotably and drivably to a handle, a second end opposite said first end, and a pair of opposite sides extending from said second end toward said first end;

(b) a tool bit receptacle located at said second end, said receptacle including a bit-receiving cavity extending into said body from said second end, said bit-receiving cavity being shaped to drivingly engage a portion of a selected tool bit, and said body defining an access opening extending transversely through said body from one of said pair of opposite sides to the other and intersecting with said bit-receiving cavity at a predetermined distance from said second end; and (c) wherein said bit-receiving cavity extends longitudinally into said body from said second end thereof and wherein a retainer spring is attached to said body and projects longitudinally into said access opening and into a space defined by an imaginary extension of said bit-receiving cavity into said access opening, and wherein said retainer spring is a flat spring and said first end thereof includes a cylindrical rolled portion and is mated with said body, and wherein a bit extending through said bit-receiving cavity into said access opening is engaged elastically by said retainer spring while extending through said bit-receiving cavity, and said bit is thereby retained in said bit holder.

* * * * *